US007425942B2

(12) United States Patent
Lee et al.

(10) Patent No.: US 7,425,942 B2
(45) Date of Patent: Sep. 16, 2008

(54) LIQUID CRYSTAL DISPLAY APPARATUS AND DRIVING METHOD THEREOF

(75) Inventors: Jae Kyun Lee, Kunpo-shi (KR); Kyong Soek Kim, Ahnyang-shi (KR)

(73) Assignee: LG Display Co., Ltd., Seoul (KR)

( * ) Notice: Subject to any disclaimer, the term of this patent is extended or adjusted under 35 U.S.C. 154(b) by 709 days.

(21) Appl. No.: 10/878,039

(22) Filed: Jun. 29, 2004

(65) Prior Publication Data

US 2005/0041006 A1 Feb. 24, 2005

(30) Foreign Application Priority Data

Aug. 21, 2003 (KR) ..... 10-2003-0058043

(51) Int. Cl.
*G09G 3/36* (2006.01)
*G09G 5/36* (2006.01)

(52) U.S. Cl. ..... 345/99; 345/98; 345/560

(58) Field of Classification Search ..... 345/99
See application file for complete search history.

(56) References Cited

U.S. PATENT DOCUMENTS 3,973,252 A * 8/1976 Mitomo et al. ..... 345/87
4,851,827 A * 7/1989 Nicholas ..... 345/93
5,165,075 A * 11/1992 Hiroki et al. ..... 349/48
5,430,460 A * 7/1995 Takabatake et al. ..... 345/96
6,300,977 B1 * 10/2001 Waechter et al. ..... 348/300
6,323,871 B1 * 11/2001 Fujiyoshi et al. ..... 345/598
6,713,783 B1 * 3/2004 Mase et al. ..... 257/59
6,727,875 B1 * 4/2004 Mikami et al. ..... 345/92
6,825,822 B2 * 11/2004 Lee ..... 345/87
6,900,854 B1 * 5/2005 Kim et al. ..... 349/43
6,982,690 B2 * 1/2006 Lee et al. ..... 345/87
7,173,600 B2 * 2/2007 Kodate et al. ..... 345/103
2002/0054003 A1 * 5/2002 Kodate ..... 345/87
2002/0084972 A1 * 7/2002 Kim ..... 345/99
2003/0107543 A1 * 6/2003 Nakano et al. ..... 345/90
2003/0227429 A1 * 12/2003 Shimoshikiryo ..... 345/90
2004/0263448 A1 * 12/2004 Baek et al. ..... 345/87
2005/0122304 A1 * 6/2005 Jang ..... 345/99

* cited by examiner

*Primary Examiner*—Amare Mengistu
*Assistant Examiner*—Elijah M Sheets
(74) *Attorney, Agent, or Firm*—McKenna, Long & Aldridge LLP

(57) ABSTRACT

A liquid crystal display apparatus and a method of driving the same capable of lowering a power consumption as well as a production cost. A liquid crystal display apparatus according to the present invention comprises: pixels including red, green and blue color pixels arranged in a direction along a data line; gate line groups, each gate line group having a set of two gate lines electrically connected each other, and each gate line crossing the data line; a data driver that drives the data line; a gate driver that drives the gate line groups; and a timing controller that controls the data driver and the gate driver, the timing controller having at least one line memory that temporarily stores data supplied to the data driver.

18 Claims, 25 Drawing Sheets

LIQUID CRYSTAL DISPLAY APPARATUS AND DRIVING METHOD THEREOF

This application claims the benefit of Korean Patent Application No. 2003-58043, filed on Aug. 21, 2003, which is hereby incorporated by reference for all purposes as if fully set forth herein.

BACKGROUND OF THE INVENTION

1. Field of the Invention

The present invention relates to a liquid crystal display, and more particularly, to a liquid crystal display apparatus and a method of driving the same capable of lowering power consumption as well as production cost.

2. Discussion of the Related Art

Recently, the importance of display devices for providing visual information has increased. Cathode ray tubes are widely used at present but has a problem in that its weight and volume are large. Therefore, various types of flat display devices have been developed that overcome the problems of the cathode ray tube.

Examples of flat panel displays include liquid crystal display (LCD) panels, field emission displays (FED), plasma display panels (PDP) and an electro-luminescence (EL) display panels, and most of these devices are commercially available.

A liquid crystal display apparatus displays a picture represented in a video signal by controlling an electric field applied to a liquid crystal layer. The liquid crystal display apparatus has been used in portable computers such as notebook personal computers, office automation equipment, audio/video machinery and the like. The liquid crystal display apparatus is thin and has a low power consumption. Thus, it has replaced the cathode ray tube in many applications.

Further, the liquid crystal display apparatus with an active liquid crystal cell using a thin film transistor (hereinafter referred to as "TFT") has the advantage that the picture quality is excellent and the power consumption is low. It has been rapidly developed into large, high definition displays due to recent productivity technology and research.

FIG. 1 shows a schematic plan view illustrating a typical liquid crystal display apparatus.

Referring to FIG. 1, the liquid crystal apparatus 1 includes: a liquid crystal display panel 2 provided with a thin film transistor (TFT) at a crossing of a data line and a gate line; a data driver 8 for providing data to the data line of the liquid crystal display panel 2; a gate driver 10 for providing a gate pulse to the gate line of the liquid crystal display panel 2; a back light unit 4 for irradiating light to the liquid crystal panel; a lamp driver 6 for driving a lamp in the back light unit 4; a timing controller 12 for controlling the data driver 8, the gate driver 10 and the lamp driver 6 of the liquid crystal display panel 2; and a power source generator 14 for supplying a power source required to the liquid crystal display panel 2 and the back light unit 4.

The liquid crystal display panel 2 has liquid crystal materials injected between two glass substrates. The TFT formed at the crossing of the data line and the gate line of the liquid crystal display panel 2 responds to a scan pulse from the gate driver 10 to apply the data in the data line to a liquid crystal cell. A source electrode of the TFT is connected to the data line, and a drain electrode is connected to the pixel electrode of the liquid crystal cell. Also, a gate electrode of the TFT is connected to the gate line.

The timing controller 12 realigns digital video data applied from a digital video card (not shown) according to red R, green G and blue B. The data RGB realigned by the timing controller 12 is applied to the data driver 8. Also, the timing controller 12 generates a data control signal (DCS) and a gate control signal (GCS) based upon a horizontal/vertical synchronization signal H, V and a clock signal (CLK) applied thereto, to thereby supply the signals to each of the data driver 8 and the gate driver 10. The data control signal (DCS) includes a dot clock signal Dclk, a source shift clock SSC, a source enable signal SOE and a polarity inversion signal POL. The gate control signal (GCS) includes a gate start pulse GSP, a gate shift clock GSC and a gate output enable GOE.

The data driver 8 samples the data in accordance with the data control signal DCS from the timing controller 12, latches the sampled data by one-line for every horizontal time (1H, 2H, . . . ), and then supplies the latched data to the data line. Moreover, the data driver 8 converts a digital pixel data R, G and B from the timing controller 12 into an analog pixel signal by using a gamma voltage GAM1 to GAM6 input from the power source generator 14, to thereby supply the analog pixel signal to the data line.

The gate driver 10 includes a shift register that sequentially generates a gate pulse in response to the gate start pulse GSP among the gate control signal GCS from the timing controller 12, and a level shifter that shifts a voltage of the gate pulse to a voltage level suitable for driving the liquid crystal cell. The gate driver 10 sequentially supplies a gate high voltage to the gate line in response to the gate control signal GCS.

The back light unit 4 includes a lamp (not shown) for irradiating light to the liquid crystal panel 2 and a lamp inverter for driving the lamp. The lamp inverter receives a lamp driving voltage Vinv from the power source generator 14 to drive the lamp.

The power source generator 14 supplies a common electrode voltage Vcom to the liquid crystal display panel 2, supplies the gamma voltage GMA1 to GMA6 to the data driver 8, and supplies the lamp driving voltage Vinv to the lamp inverter.

FIG. 2 is a perspective view illustrating the liquid crystal display panel shown in FIG. 1. The liquid crystal display panel 2 of the typical liquid crystal display apparatus 1 includes a color filter array substrate 20 and a TFT array substrate 30 that are combined with each other with a liquid crystal layer 15 positioned therebetween. The liquid crystal display panel 2 shown in FIG. 2 represents a portion of a full display.

In the color filter array substrate 20, a color filter 24 and a common electrode 26 are formed on a rear surface of an upper glass substrate 22. A polarizer 28 is attached on an upper surface of the glass substrate 22.

The color filter 24 includes the color filter layers of red R, green G and blue B colors that transmit light with a particular wavelength bandwidth to display colors. A black matrix (not shown) is formed between the adjacent color filters 24. The black matrix is formed between the color filters 24 of red R, green G and blue B to separate the color filters 24 from each other and to absorb the light incident from adjacent cells, to thereby prevent deterioration in contrast.

In the TFT array substrate 30, data lines 34 and gate lines 40 cross on the surface of a lower glass substrate 32. TFTs 38 are formed at the crossings of the data lines 34 and the gate lines 40. A pixel electrode 36 is formed at cell regions between each of the data lines 34 and each of the gate lines 40 across the entire surface of the lower glass substrate 32. Each of the TFTs 38 includes a gate electrode connected to the gate line 40, a source electrode connected to the gate line 34 and a drain electrode facing to the source electrode with a channel positioned therebetween. The TFT 38 is connected to the pixel electrode 36 via a contact hole passing through the drain electrode. The TFT 38 selectively provides a data signal from the data line 34 to the pixel electrode 36 in response to a gate pulse from the gate line 40. The TFT 38 opens a data path between the data line 34 and the pixel electrode 36 in response to the gate pulse from the gate line 40, to thereby drive the pixel electrode 36. A polarizer 42 is disposed on a rear surface of the TFT array substrate 30.

The pixel electrode 36 is positioned in a cell region partitioned by the data line 34 and the gate line 40 and is made of a transparent conductive material having a high light transmittance. The pixel electrode 36 generates a voltage difference along with a common electrode 26, which is formed on the upper glass substrate 22. A data signal inputted via the drain electrode produces the voltage difference. The liquid crystal layer 15 adjusts an amount of light passing through the TFT array substrate 30 in response to an applied electric field. The liquid crystal material of the liquid crystal layer 15 positioned between the lower glass substrate 32 and the upper glass substrate 22 rotates when an electric field is applied due to a dielectric anisotropy. Accordingly, the light that is enters the pixel electrode 36 from the light source is transmitted toward the upper glass substrate 22.

Polarizers 28 and 42 on the color filter array substrate 20 and the TFT array substrate 30 transmit light polarized in only one direction. When the liquid crystal material 15 is in a 90° TN mode, the polarization directions of the polarizers 28 and 42 are perpendicular each other. An alignment film (not shown) is formed on the facing surfaces of the color filter array substrate 20 and the TFT array substrate 30.

A process for fabricating the typical liquid crystal display panel 2 includes the following stops of substrate cleaning, substrate patterning, alignment film forming/rubbing, substrate assembling, liquid crystal material injecting, mounting, inspecting and repairing processes.

The substrate cleaning process removes the impurities remaining before/after patterning the upper glass substrate 22 and the lower glass substrate 32 using a detergent.

The substrate patterning process is divided into a patterning process of the color filer array substrate 20 and a patterning process of the TFT array substrate 30.

The color filter 24, the common electrode 26 and the black matrix (not shown) are formed on the upper glass substrate 22 of the color filter array substrate 20. Signal lines such as the data lines 34 and the gate lines 40 are formed on the lower glass substrate 32 of the TFT array substrate 30. Each of the TFTs 38 is formed at the crossing of each data line 34 and each gate line 40. The pixel electrodes 36 are formed in pixel regions between the gate lines 40 and the data lines 34.

The alignment film forming/rubbing process applies an alignment film to the color filter array substrate 20 and the TFT array substrate 30 and then rubs the alignment film.

The substrate assembling process and the liquid crystal material injecting process includes forming a sealant pattern on the color filter array substrate 20 or the TFT array substrate 30, discharging a gas filled inside of the liquid crystal display panel 2, injecting liquid crystal materials and a spacer through a liquid crystal injection hole, and sealing the liquid crystal injection hole while assembling the color filter array substrate 20 having the sealant pattern or the TFT array substrate 30 having the sealant pattern by using an assembling apparatus, to thereby fabricate the liquid crystal display panel 2.

In the mounting process of the liquid crystal panel, a tape carrier package (hereinafter referred to as a "TCP") is connected to a pad part on the substrate. The TCP has integrated circuits mounted thereon such as a gate driver integrated circuit and a data driver integrated circuit. Such gate and data driver integrated circuits may be directly mounted on the substrate by using a chip on glass (hereinafter referred to as a "COG") method as well as a TAB (Tape Automated Bonding) using the TCP as described above.

The inspecting process includes an electrical inspection performed after forming a variety of signal lines such as the data line 34 and the gate line 40 on the TFT array substrate 30 and the pixel electrode 36, and an electrical inspection and a visual inspection performed after the substrate assembling process and the liquid crystal material injection process. Specifically, the electrical inspection for the signal lines of the TFT array substrate 30 and the pixel electrode 36 before being performed the substrate assembling may increase the yield and may identify a defective substrate at an early stage that maybe repairable.

The repairing process repairs the substrate as determined by the inspection process. However, in the inspection process, defective substrates beyond repair are discarded.

FIG. 3 is a plan view representing a structure of a color pixel of the liquid crystal display panel shown in FIG. 2.

Referring to FIG. 3, in a liquid crystal display panel 2, an arrangement of color pixels 44 constituting a pixel 42 are designed by three color pixels R, G and B. A red color pixel 44R, a green color pixel 44G and a blue color pixel 44B are arranged on a horizontal line and red, green, and blue color pixels 44 are arranged in a stripe pattern in a vertical direction. One pixel 42 includes units of the red color pixel 44R, the green color pixel 44G, and the blue color pixel 44B formed on the horizontal line. Repeating the pixels 42 constitutes one pixel line, and the entire liquid crystal display apparatus constitutes by many pixel lines. Each of the color pixels 44 are driven by the TFTs 38.

FIG. 4A is a waveform representing a gate pulse waveform inputted to the liquid crystal panel shown in FIG. 3. FIG. 4B is a waveform representing an input signal and an output signal of a gate driver integrated circuit and a data driver integrated circuit of a typical liquid crystal display apparatus.

Placing a voltage on the color pixels of the liquid crystal display panel 2 will be described in detail in conjunction with FIGS. 4A to 4B.

If a gate shift clock GSC synchronized with a falling time of a data enable signal DE is generated, then a scan pulse having a gate high voltage Gout corresponding to one horizontal period 1H is sequentially supplied to the gate lines 40. A source start pulse SSP representing the beginning timing of a data sampling of a data driver circuit is synchronized at a rising time of the data enable signal DE, and a source out enable SOE signal representing the timing of outputting a data voltage from the data driver circuits is generated and delayed by a designated time from the falling time of the data enable DE signal for each one-horizontal period 1H. Each data voltage Sout is supplied to its corresponding data line 34 in synchronization with the source out enable SOE signal, and the data voltage is charged in the R, G, and B color pixels 44 via the TFT 38 that is turned-on by the data line 34 and the scan pulse. The voltage charged on the R, G, and B color pixels 44 drives the liquid crystal material to display a picture.

The data driver IC drives a plurality of data lines using a data voltage supplied to the color pixels 44 of the liquid crystal display apparatus 1. Therefore, the data driver IC consumes a large amount of power. As the liquid crystal display apparatus 1 tends to be made with increased resolution and a larger screen, the number of pixels increases accordingly. Further, as the number of pixels increases, the number of the data lines 34 to supply the data voltage to the color pixels 44 also increases. Accordingly, in the liquid crystal display apparatus 1, the number of the data driver ICs for driving the data line 34 increases pursuant to the increased number of data lines. Thus, there is a problem that production cost is increased.

SUMMARY OF THE INVENTION

Accordingly, it is an advantage of the present invention to provide a liquid crystal display apparatus and a method of driving the same capable of lowering a power consumption as well as a production cost.

In order to achieve these and other advantages of the invention, a liquid crystal display apparatus according to the present invention includes: pixels including red, green and blue color pixels arranged in a direction along a data line; gate line groups, each gate line group having a set of two gate lines electrically connected each other, and each gate line crossing the data line; a data driver that drives the data line; a gate driver that drives the gate line groups; and a timing controller that controls the data driver and the gate driver, the timing controller having at least one line memory that temporarily stores data supplied to the data driver.

Another advantage of the present invention is achieved by a method of driving a liquid crystal display apparatus according to the present invention, the liquid crystal display apparatus including pixels with red, green and blue color pixels arranged in vertical along a data line; and gate line groups, each gate line group having a set of two gate lines electrically connected each other, each gate line crossing the data line, the method including: sequentially supplying a gate pulse having first and second gate pulses to the gate line group; and supplying designated data to each of the red, the green and the blue color pixels in accordance with the first and the second pulses sequentially supplied to the gate line group.

BRIEF DESCRIPTION OF THE DRAWINGS

These and other advantages of the invention will be apparent from the following detailed description of the embodiment of the present invention with reference to the accompanying drawings, in which.

DETAILED DESCRIPTION OF THE ILLUSTRATED EMBODIMENTS

Reference will now be made in detail to embodiments of the present invention, examples of which are described in detail with reference to FIGS. 5 to 24.

Figure 1:
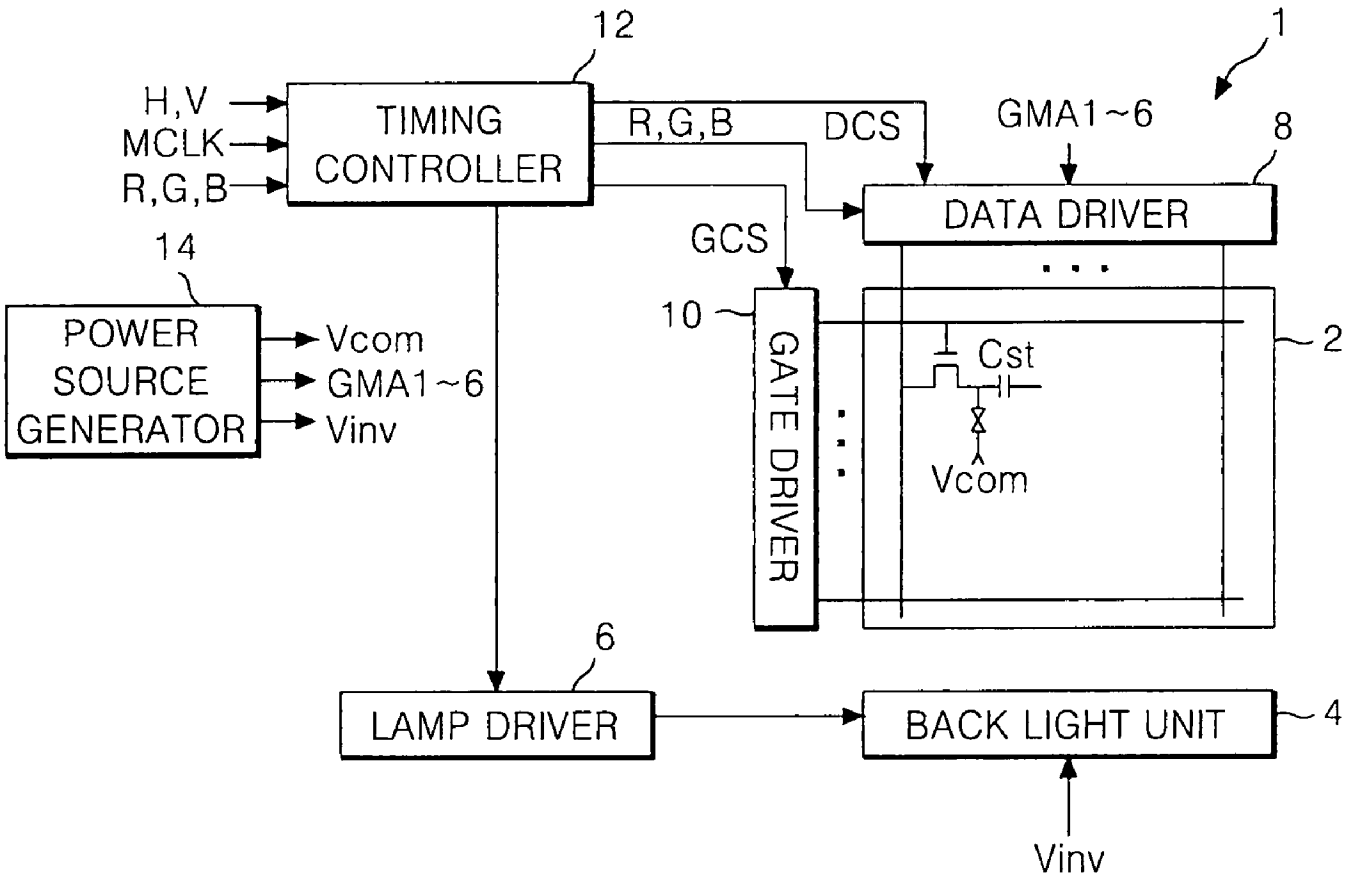
FIG. 1 RELATED ART
FIG. 1 is a schematic block diagram representing a liquid crystal display apparatus of a related art.
Figure 2:
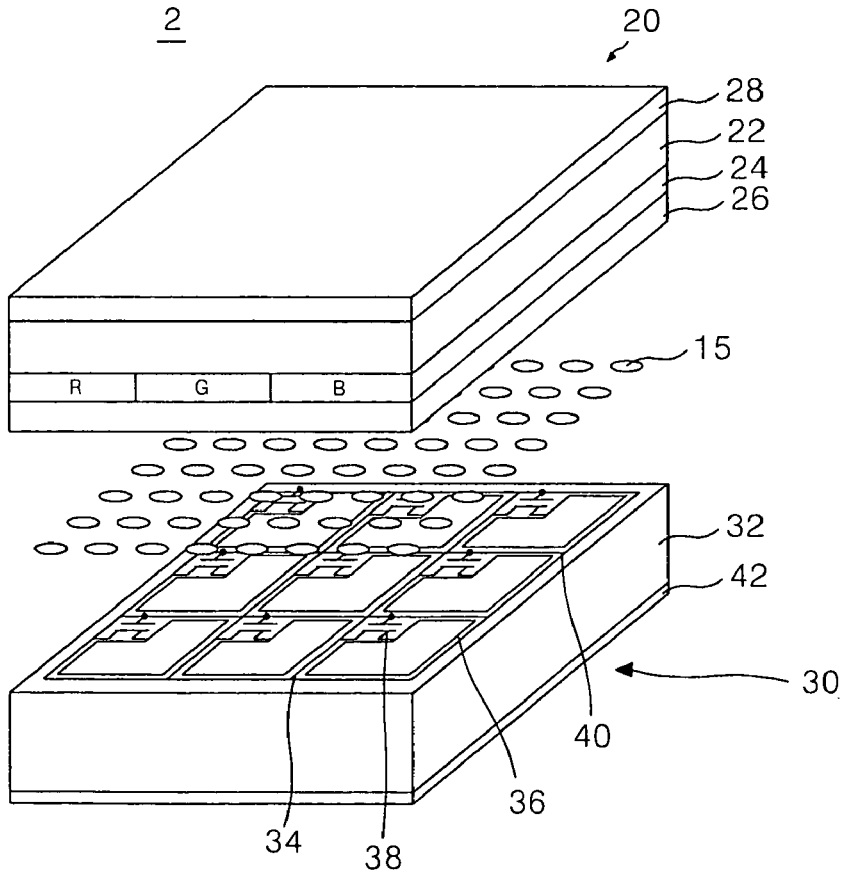
FIG.2 RELATED ART
FIG. 2 is a perspective view representing a liquid crystal display panel shown in FIG. 1.
Figure 3:
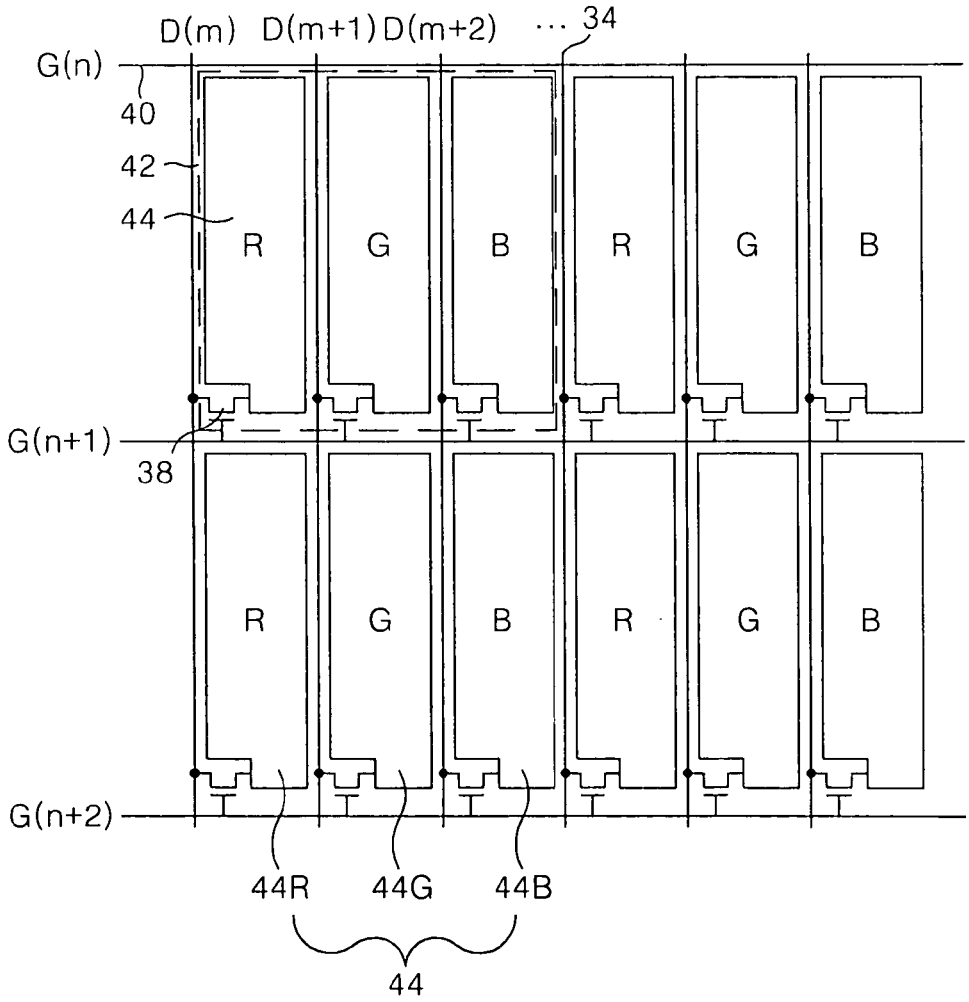
FIG.3 RELATED ART
FIG. 3 is a plan view representing a structure of a pixel including color pixels of the liquid crystal display panel shown in FIG. 2.
Figure 4A:
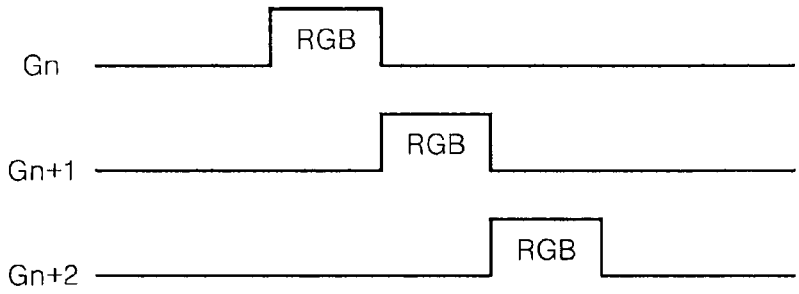
FIG.4A RELATED ART
FIG. 4*a* is a waveform diagram representing an input signal and an output signal of the gate driver integrated circuit and the data driver integrated circuit of the general liquid crystal display apparatus.
Figure 4B:
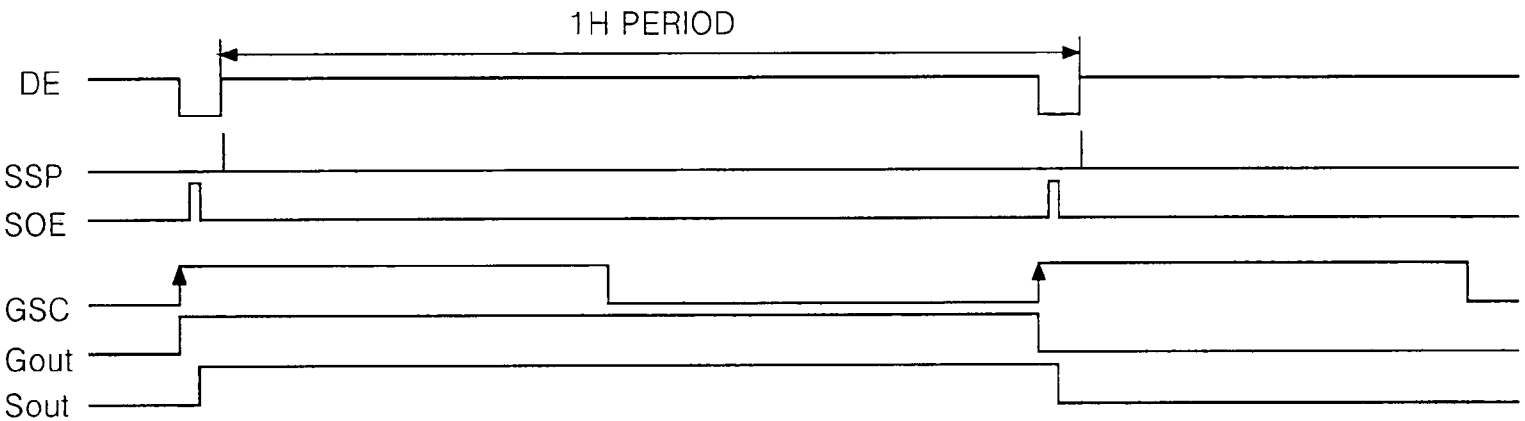
FIG. 4B RELATED ART
FIG. 4B is a waveform diagram representing a gate pulse waveform inputted to the liquid crystal display panel shown in FIG. 3.
Figure 5:
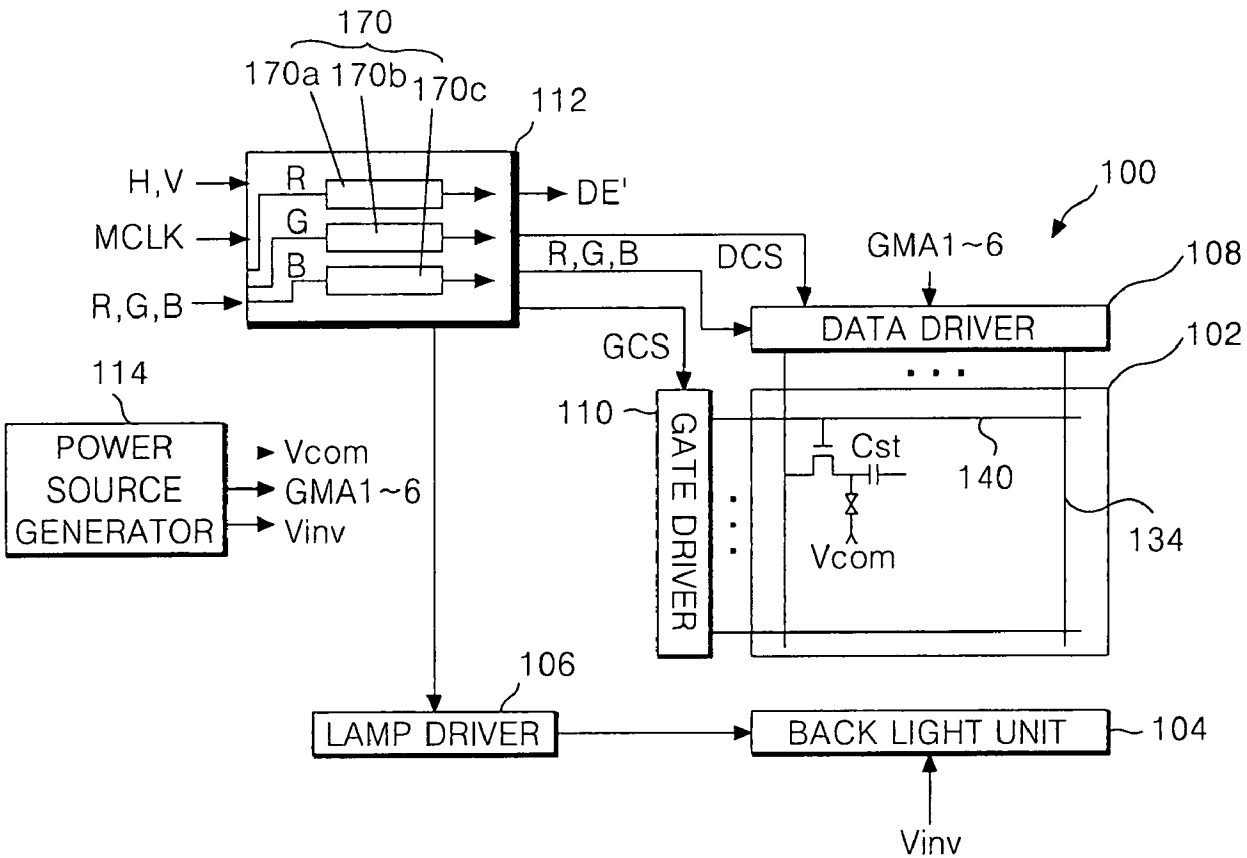
FIG. 5 is a block diagram representing a liquid crystal display apparatus according to a first embodiment of the present invention.

FIG. 5 is a plan view representing a liquid crystal display apparatus according to a first embodiment of the present invention.

Referring to FIG. 5, the liquid crystal apparatus 100 includes: a liquid crystal display panel 102 with a thin film transistor (TFT) at a crossing of a data line 134 and a gate line 140; a data driver 108 for providing data to the data line 134 of the liquid crystal display panel 102; a gate driver 110 for providing a gate pulse to the gate line 140 of the liquid crystal display panel 102; a back light unit 104 for irradiating light to the liquid crystal panel 102; a lamp driver 106 for driving a lamp of the back light unit 104; a timing controller 112 for controlling the data driver 108, the gate driver 110 and the lamp driver 106 of the liquid crystal display panel 102; and a power source generator 114 for supplying a power source required to the liquid crystal display panel 102 and the back light unit 104.

The liquid crystal display panel 102 has liquid crystal materials injected between two glass substrates. The TFT formed at the crossing of the data line 134 and the gate line 140 responds to the gate pulse from the gate driver 110 to apply the data on the data line 134 to a liquid crystal cell. A source electrode of the TFT is connected to the data line 134, and a drain electrode is connected to the pixel electrode of the liquid crystal cell. Also, a gate electrode of the TFT is connected to the gate line 140.

The timing controller 112 realigns digital video data applied from a digital video card (not shown) according to red R, green G and blue B. Each R, G, B data realigned by the timing controller 112 is separately stored in a line memory 170 formed in the timing controller 112. The red R data is stored in a first line memory 170*a*, the green G data is stored in a second line memory 170*b*, and the blue B data is stored in a third line memory 107*c*. Each of the red R, green G and blue B data stored in each of the line memories 170*a*, 170*b* and 170*c* is provided to the data driver 108. Also, the timing controller 112 generates a data control signal DCS and a gate control signal GCS based upon of a horizontal/vertical synchronization signal H/V and a main clock signal MCLK applied thereto to supply the signals to the data driver 108 and the gate driver 110. The data control signal DCS includes a dot clock signal Dclk, a source shift clock SSC, a source enable signal SOE and a polarity inversion signal POL. Also, the gate control signal GCS includes a gate start pulse GSP, a gate shift clock GSC and a gate output enable GOE.

The data driver 108 samples the digital data in accordance with the data control signal DCS from the timing controller 112, latches the sampled data by one-line for every horizontal time (1H, 2H, . . . ), and then supplies the latched data to the data line 134. Moreover, the data driver 108 converts the digital pixel data R, G and B from the timing controller 112 into an analog pixel signal by using a gamma voltage GAM1 to GAM6 provided from the power source generator 114 to supply the analog pixel signal to the data line 134.

The gate driver 110 includes a shift register that sequentially generates the gate pulse in response to the gate control signal GCS from the timing controller 112, and a level shifter that shifts a voltage of the gate pulse to a voltage level suitable for driving the liquid crystal cell. The gate driver 110 sequentially supplies a gate high voltage to the gate line in response to the gate control signal GCS.

The back light unit 104 includes a lamp (not shown) for irradiating light to the liquid crystal panel 102 and a lamp inverter for driving the lamp. The lamp receives a driving voltage form the lamp inverter to generate the light. The lamp inverter receives a lamp driving voltage Vinv from the power source generator 114 to drive the lamp.

The power source generator 114 supplies a common electrode voltage Vcom to the liquid crystal display panel 102, supplies the gamma voltage GMA1 to GMA6 to the data driver 108, and supplies the lamp driving voltage Vinv to the lamp inverter.

Figure 6:
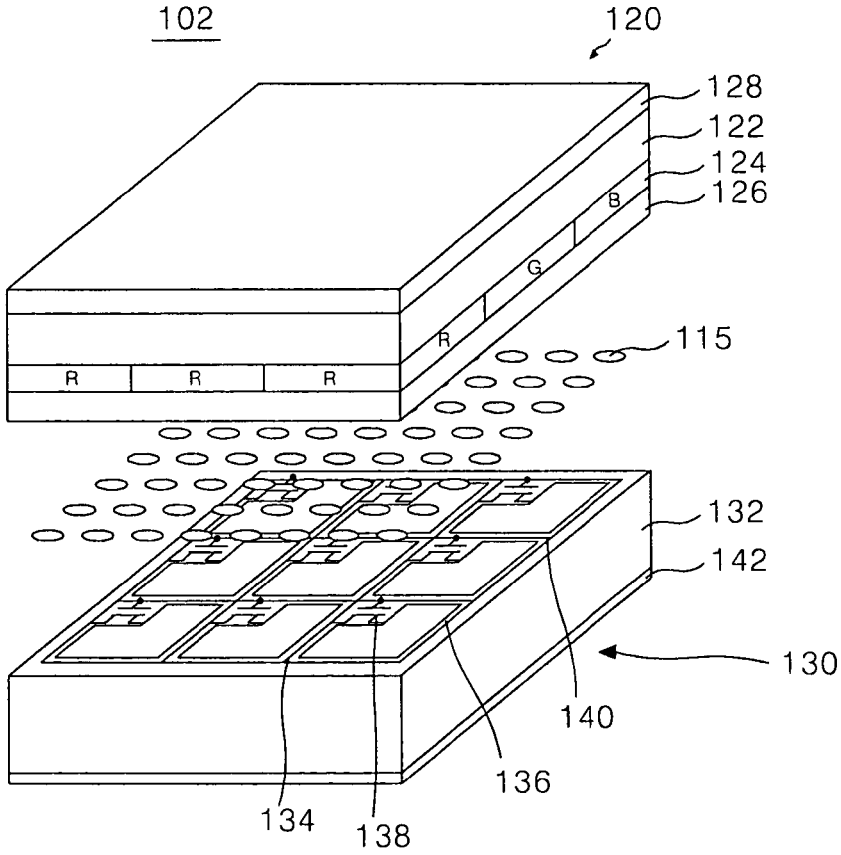
FIG. 6 is a perspective view representing a liquid crystal display panel shown in FIG. 5.

FIG. 6 is a perspective view representing the liquid crystal display panel shown in FIG. 5. The liquid crystal display panel 102 of the liquid crystal display apparatus is made by combining a color filter array substrate 120 and a TFT array substrate 130, wherein a liquid crystal layer 115 is positioned between the color filter array substrate 120 and the TFT array substrate 130. The liquid crystal display panel 102 shown in FIG. 6 represents a portion of a full display.

In the color filter array substrate 120, a color filter 124 and a common electrode 126 are formed on a rear surface of an upper glass substrate 122. A polarizer 128 is attached on an upper surface of the glass substrate 122.

The color filter 124 includes color filter layers of red R, green G and blue B colors disposed therein and transmit light of particular wavelength bandwidths to display colors. A black matrix (not shown) is formed between the adjacent color filters 124. The black matrix formed between the color filters 124 of red R, green G and blue B serves to separate the color filters 124 from each other and to absorb an incident light from adjacent cells, to thereby prevent deterioration in contrast.

In the TFT array substrate 130, data lines 134 and gate lines 140 cross on the surface of a lower glass substrate 132. TFTs 138 are formed at each crossing of the data line 134 and the gate line 140. A pixel electrode 136 is formed at cell regions between the data lines 134 and the gate lines 140 across the entire surface of the lower glass substrate 132. The TFTs 138 include a gate electrode connected to the gate line 140, a source electrode connected to the gate line 134 and a drain electrode facing to the source electrode wherein a channel is positioned between the source and drain electrodes facing each other. The TFT 38 is connected to the pixel electrode 136 via a contact hole passing through the drain electrode. The TFT 138 selectively provides a data signal from the data line 134 to the pixel electrode 136 in response to the gate pulse from the gate line 140. The TFT 138 opens a data path between the data line 134 and the pixel electrode 136 in response to the gate pulse from the gate line 140, to thereby drive the pixel electrode 136. The polarizer 142 is disposed on a rear surface of the TFT array substrate 130.

The pixel electrode 136 is positioned in a cell region partitioned by the data line 134 and the gate line 140 and is made of a transparent conductive material having a high light transmittance. The pixel electrode 136 generates a voltage difference along with a common electrode 126, the common electrode 126 formed on the upper glass substrate 122. A data signal provided via the drain electrode produces the voltage difference. The liquid crystal layer 115 adjusts an amount of light passing through the TFT array substrate 130 in response to an applied electric filed. A liquid crystal material of the liquid crystal layer 115 positioned between the lower glass substrate 132 and the upper glass substrate 122 rotates when an electric field is applied due to a dielectric anisotropy. Accordingly, the light that enters the pixel electrode 136 from the light source is transmitted forward the upper glass substrate 122.

Polarizers 128 and 142 on the color filter array substrate 120 and the TFT array substrate 130 transmit light polarized in only one direction. When the liquid crystal 115 is in a 90° TN mode, the polarization directions of the polarizers 128 and 142 are perpendicular to each other. An alignment film (not shown) is formed on facing surfaces of the color filter array substrate 120 and the TFT array substrate 130.

A process for fabricating the liquid crystal display panel 102 includes the following steps of substrate cleaning, substrate patterning, alignment film forming/rubbing, substrate assembling, crystal material injecting, mounting, inspecting and repairing processes.

The impurities remaining on the substrates before/after patterning the upper glass substrate 122 and the lower glass substrate 132 are removed by a detergent during the substrate cleaning process.

The substrate patterning process is divided into a patterning process of the color filer array substrate 120 and a patterning process of the TFT array substrate 130.

The color filter 124, the common electrode 126 and the black matrix (not shown) are formed on the upper glass substrate 122 of the color filter array substrate 120. Signal lines such as the data lines and the gate lines are formed on the lower glass substrate 132 of the TFT array substrate 130. The TFT 138 is formed at the crossing of the data line 134 and the gate line 140. Pixel electrodes 136 are formed in pixel regions between the gate lines 140 and the data lines 134.

The alignment film forming/rubbing process applies an alignment film to the color filter array substrate 120 and the TFT array substrate 130 and then rubs the alignment film.

The substrate assembling process and the liquid crystal injecting process includes forming a sealant pattern on the color filter array substrate 120 or the TFT array substrate 130, discharging a gas filled inside of the liquid crystal display panel 102, injecting the liquid crystal material and a spacer through a liquid crystal injection hole, and sealing the liquid crystal injection hole while assembling the color filter array substrate 120 or the TFT array substrate 130 in which the sealant pattern is formed by an assembling apparatus, to thereby fabricate the liquid crystal display panel 102.

In the mounting process of the liquid crystal panel, a tape carrier package (a "TCP") is connected to a pad part on the substrate, wherein the TCP has integrated circuits mounted thereon such as a gate driver integrated circuit and a data driver integrated circuit. Such driver integrated circuits may be directly mounted on the substrate by using a chip on glass (a "COG") method as well as a TAB (Tape Automated Bonding) using the TCP as described above.

The inspecting process includes an electrical inspection performed after forming a variety of signal lines such as the data line 134 and the gate line 140 on the TFT array substrate 130 and the pixel electrode 36, and an electrical inspection and a visual inspection performed after the substrate assembling and the liquid crystal injection process. Specifically, the electrical inspection of the signal lines of the TFT array substrate 130 and the pixel electrode 136 before being performed the substrate assembling may increase the yield and may identify a defective substrate repairable.

The repairing process repairs the substrate as determined by the inspection process. However, in the inspection process, defective substrates beyond repair are discarded.

Figure 7:
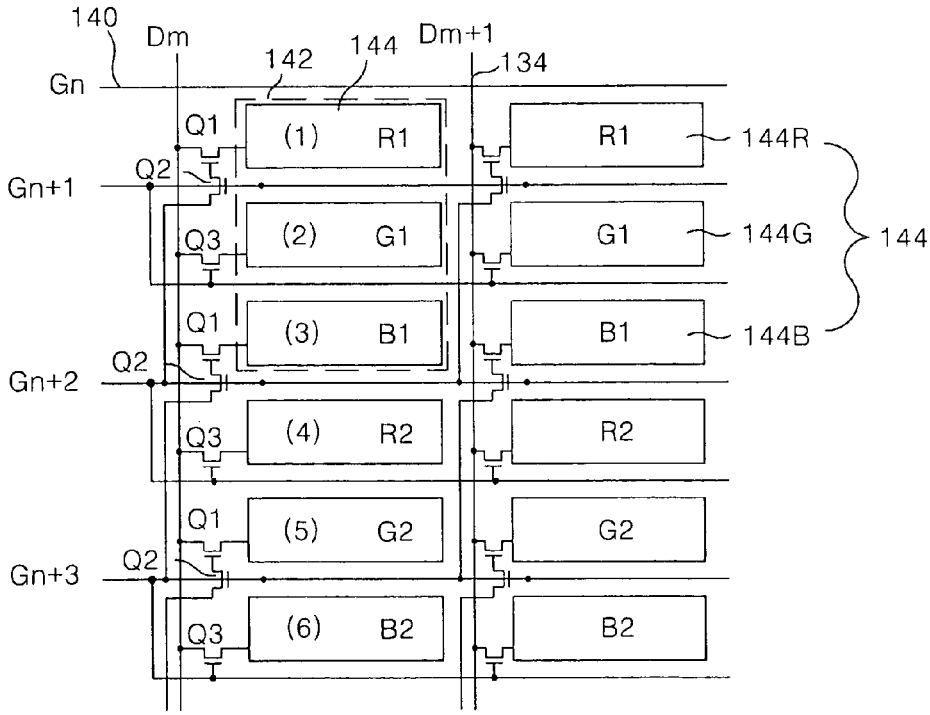
FIG. 7 is a plan view representing a structure of a color pixel constituting a pixel of the liquid crystal display panel shown in FIG. 6.

FIG. 7 is a plan view representing a structure of a color pixel of the liquid crystal display panel shown in FIG. 6.

Referring to FIG. 7, in liquid crystal display apparatus 100 according to the first embodiment of the invention color pixels 144 constituting a pixel 142 are designed in a vertical direction with three color pixels R, G and B in order to reduce the number of the data lines 134 by ⅔. More particularly, the liquid crystal display apparatus 100 according to the first embodiment arranges a red color pixel 144R, a green color pixel 144G and a blue color pixel 144B in a vertical line and arranges color pixels 144 of red R, green G and blue B in a stripe pattern in a horizontal direction. A unit including a red color pixel 144R, a green color pixel 144G and a blue color pixel 144B formed in the vertical line constitutes one pixel 142. A plurality of pixels 142 constitutes one pixel line, and the liquid crystal display has many pixel lines. The TFT 138 drives each of the color pixels 144. Accordingly, the liquid crystal display apparatus 100 according to the first embodiment of invention can reduce the number of the data lines 134 by ⅔ by driving the color pixel 144 with one data line 134. If the number of the data lines 134 is reduced by ⅔, the number of the gate lines should be also increased by a factor of three. However, according to the liquid crystal display apparatus 100 of the present invention, the number of the gate lines 140 is increased by 1.5 times by designating two gate lines 140 as a common line.

Each TFT 138 driving the color pixel 144 includes: a first TFT Q1, being connected to the red pixel 144R and the data line 134 and having a gate pulse from a n+2th gate line Gn+2 supplied thereto; a third TFT Q3, being connected to the green pixel 144G and the data line 134 and having a gate pulse from a n+1th gate line Gn+1 supplied thereto; and a second TFT Q2, being connected to the n+2th gate line Gn+2 and the first TFT Q1 and providing a gate pulse supplied to the n+2th gate line Gn+2 to the first TFT Q1 in response to a gate pulse from the n+1th gate line Gn+1. A dummy gate line is connected to the n+1th gate line Gn+1 and is formed between the n+1th gate line Gn+1 and the n+2th gate line Gn+2. Each of the first to the third TFTs Q1, Q2 and Q3 drives a set of two color pixels adjacent in vertical direction in response to the gate pulse from a set of two gate lines Gn+1 and Gn+2.

Figure 8:
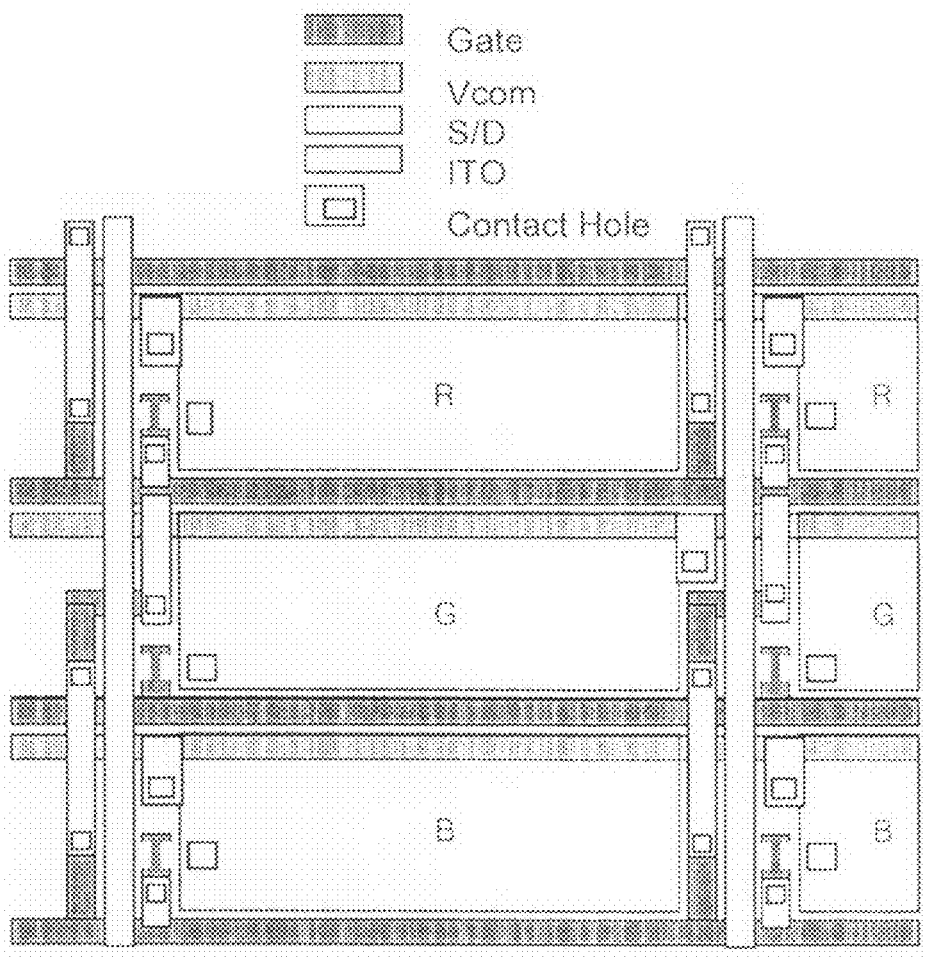
FIG. 8 is a plan view representing a layout of the liquid crystal display panel shown in FIG. 7.

The color pixels 144 constituting the pixel 142, the TFTs Q1, Q2 and Q3 driving each color pixel 144, the gate line 140 and the data line 134 in the liquid crystal display apparatus according to the first embodiment may be formed by using a layout shown in FIG. 8.

Figure 9:
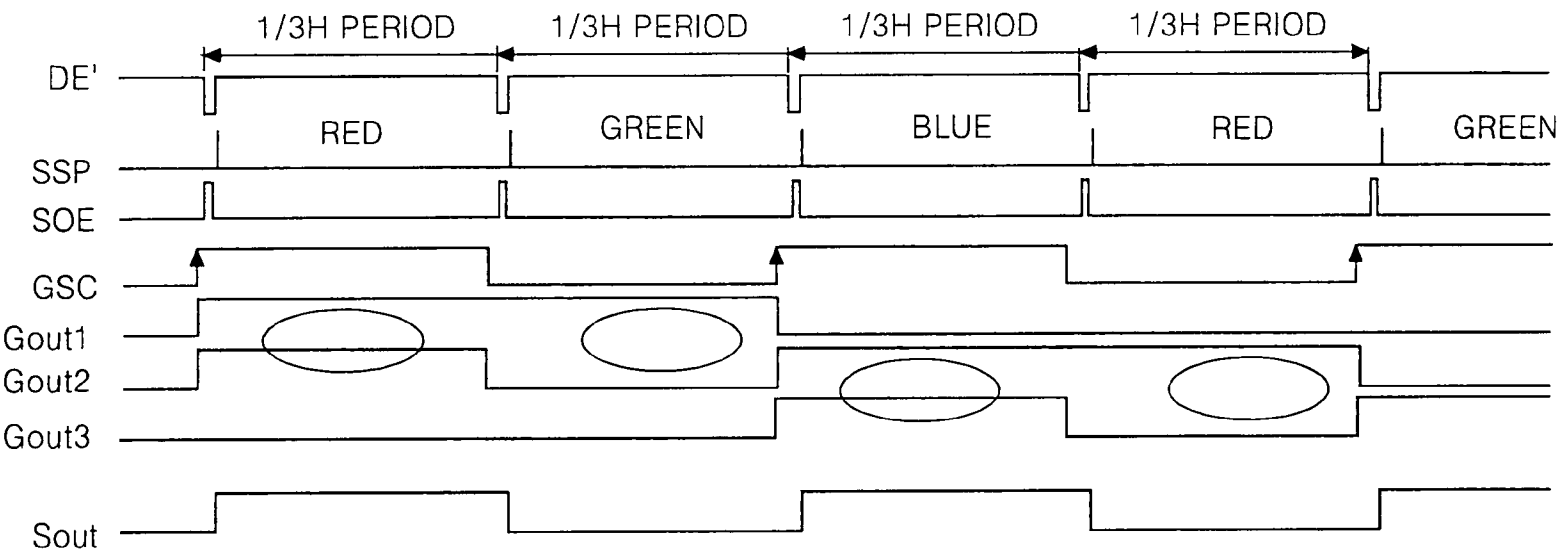
FIG. 9 is a waveform representing an input signal and an output signal of a gate driver integrated circuit and a data driver integrated circuit of the liquid crystal display apparatus according to a first embodiment of the present invention.

FIG. 9 shows the waveforms representing an input signal and an output signal of a gate driver integrated circuit and a data driver integrated circuit in the liquid crystal display apparatus according to the first embodiment of the present invention.

Signals supplied to the liquid crystal display panel 102 of the liquid crystal display apparatus according to the first embodiment of the present invention will be described in detail in conjunction with FIG. 9.

If a gate shift clock GSC synchronized at a falling time of a data enable signal DE' generated for every ⅓-horizontal period (⅓H) is generated for a ⅔-horizontal period (⅔H), then scan pulses of gate high voltages Gout1 to Gout3 having first and second gate pulses are sequentially supplied to the gate line 140. A source start pulse SSP indicating the beginning timing of a data sampling for a data driver circuit is synchronized at a rising time of the data enable signal DE', and a source out enable SOE signal indicating the timing for outputting a data voltage for the data driver circuit is generated and delayed by an amount of designated time from the falling time of the data enable DE' signal for every ⅓-horizontal period (⅓H). A data voltage Sout is supplied to the data line 134 for every ⅓-horizontal period (⅓H) in synchronization with the source out enable SOE signal, and the data voltage is charged in the R, G, and B color pixels 144 via the TFT 138 turned-on by the data line 134 and the scan pulse. The voltage charged on the R, G, and B color pixels 144 drives a liquid crystal material, to thereby display a picture.

Figure 10:
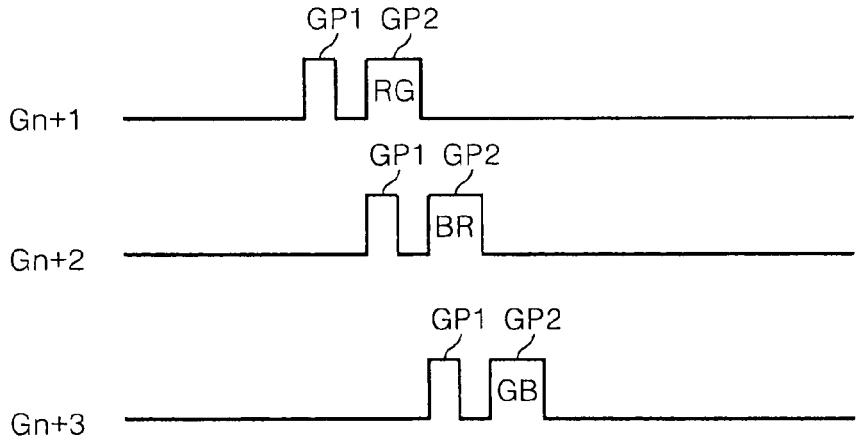
FIG. 10 is a waveform diagram representing a signal provided to a gate line of a liquid crystal display panel.

FIG. 10 is a waveform diagram representing a signal provided to a gate line of the liquid crystal display panel.

The operation of the color pixels in the liquid crystal display panel 102 will be described in detail in conjunction with FIGS. 7 to 10.

If a second gate pulse GP2 is supplied to the gate line Gn+1 when a first gate pulse GP1 is supplied to the gate line Gn+2, the first to the third TFTs Q1, Q2 and Q3 are turned-on. At this time, as the second TFT Q2 is turned-on by the second gate line Gn+2 supplied to the gate line Gn+1, the first TFT Q1 is turned-on by the first gate pulse GP1 supplied to the gate line Gn+2. As described above, if the first TFT Q1 is turned-on, the red R data supplied to a data line Dm is provided to a first red color pixel R1 via the first TFT Q1 and is simultaneously supplied to a first green color pixel G1 via the third TFT Q3.

In a period during which the gate pulse GP1 supplied to the gate line Gn+2 is off and only the second gate pulse GP2 is supplied to the gate line Gn+2, the first TFT Q1 is turned-off by the first gate pulse GP1 and the third TFT Q3 maintains a turn-on state by the second gate pulse GP2. While the third TFT Q3 maintains the turn-on state, the green G data supplied to the data line Dm is provided to the first green color pixel G1 via the third TFT Q3. As a result, the red R data supplied to the first green color pixel G1 is changed to the green G data.

Thereafter, if first and the second gate pulses GP1 and GP2 are supplied to a gate line Gn+3 and the gate line Gn+2, then, as described above, the blue B data supplied to the data line Dm is provided to a first blue color pixel B1 and a second red color pixel R2 during the overlap of the first and the second gate pulses with each other. Also, in a period during which the gate pulse GP1 supplied to the gate line Gn+3 is off and only the second gate pulse GP2 is supplied to the gate line Gn+2, the red R data supplied to the data line Dm by the second gate pulse GP2 supplied to the gate line Gn+2 is supplied to the second red color pixel R2. As a result, the blue B data supplied to the second red color pixel R2 is changed to the red R data.

Figure 11:
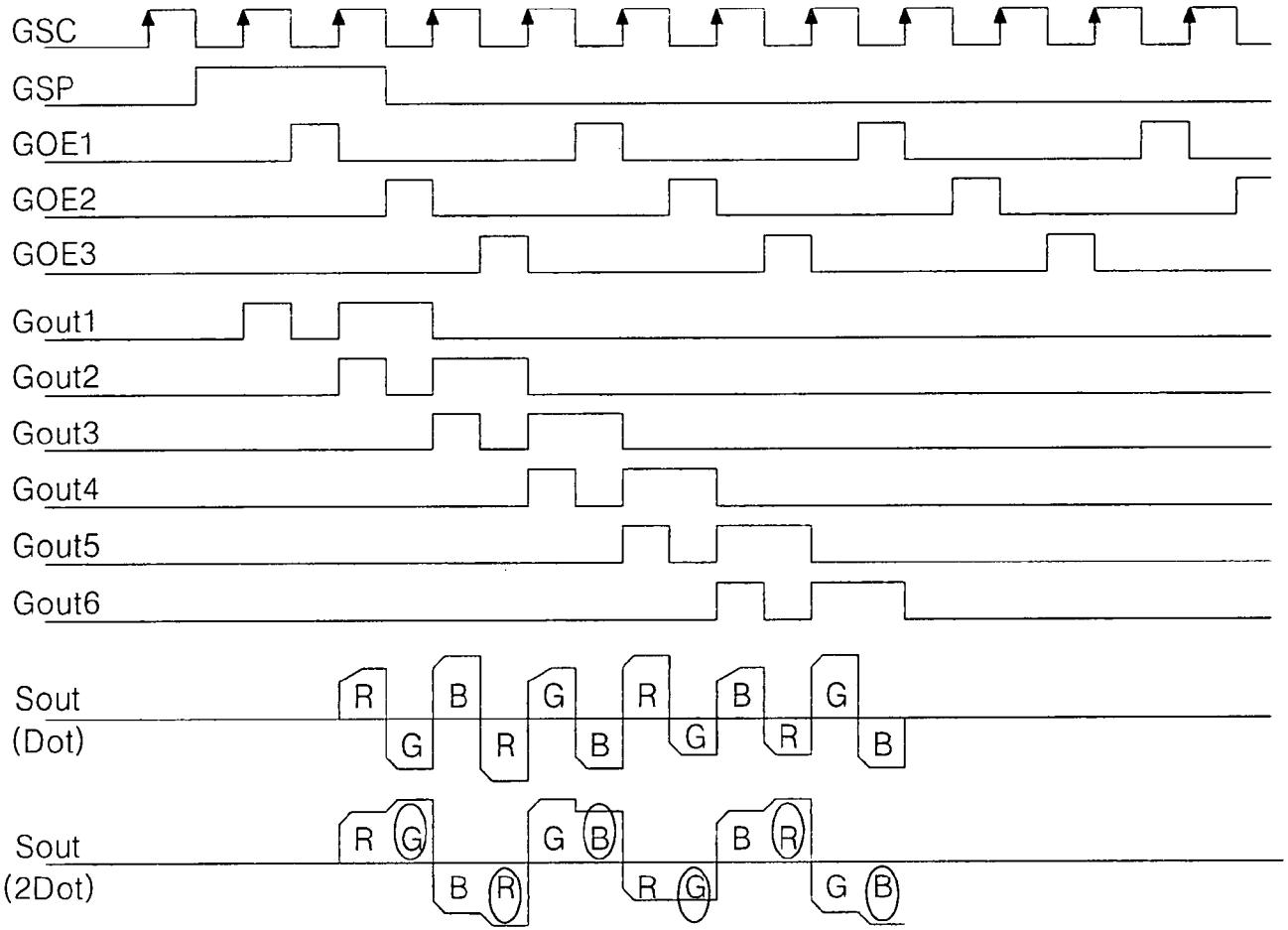
FIG. 11 is a waveform diagram representing a signal provided to the liquid crystal display apparatus and an output waveform according to the first embodiment of the present invention.

In the first embodiment of the present invention, the red R, green G and blue G data supplied to the data line Dm are provided to the color pixels 144 by repeating the process as described above. The red R, green G and blue B data supplied to the color pixels 144 may be driven by using a one-dot inversion method or a two-dot inversion method as shown in FIG. 11.

Figure 12:
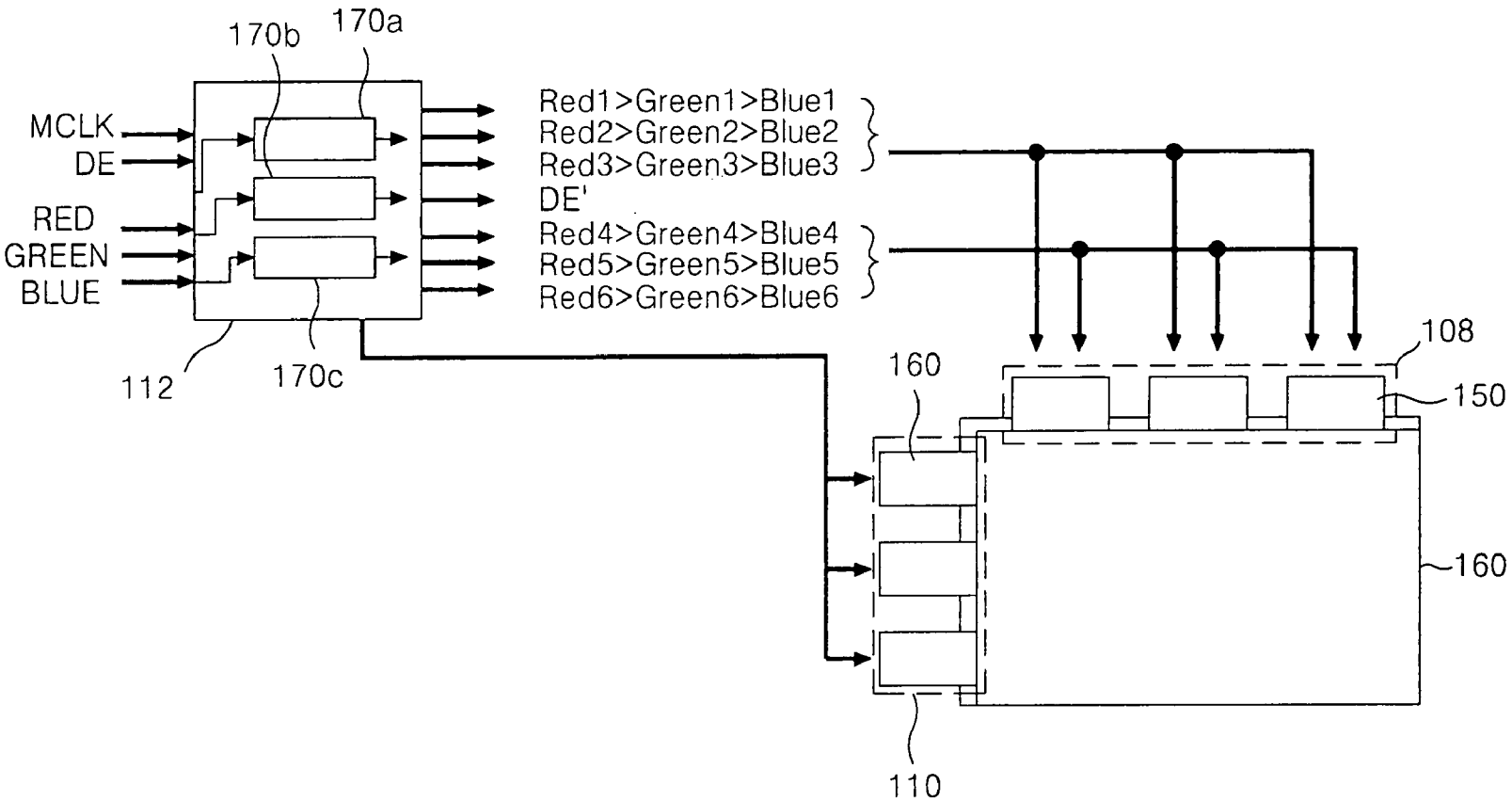
FIG. 12 is a configuration representing a signal and a data inputted/outputted to the liquid crystal display apparatus according to the first embodiment of the present invention.
Figure 13:
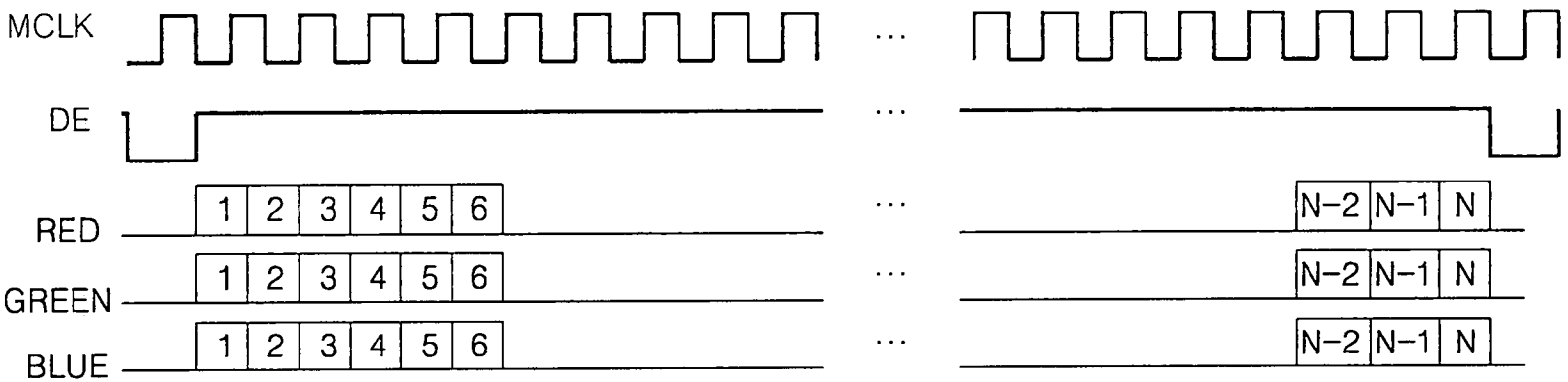
FIG. 13 is a waveform diagram representing a signal and a data provided to a timing controller of the liquid crystal display apparatus shown in FIG. 12.

FIG. 12 illustrates signals and data inputted/outputted to the liquid crystal display apparatus according to the first embodiment of the present invention.

Referring to FIG. 12, a main clock MCLK, a data enable DE and the R, G and B data are input to a timing controller 112 of the liquid crystal display apparatus according to the first embodiment. The R, G, B data is synchronized with the main clock MCLK and stored in a line memory 170*a*, 170*b* and 170*c*. The red R data is stored in a first line memory 170*a*, the green G data is stored in a second line memory 170*b*, and the blue B data is stored in a third line memory 107*c*. The data R, G, B is synchronized with the main clock MCLK to be stored in the first to the third line memories 170*a*, 170*b* and 170*c*.

Figure 14:
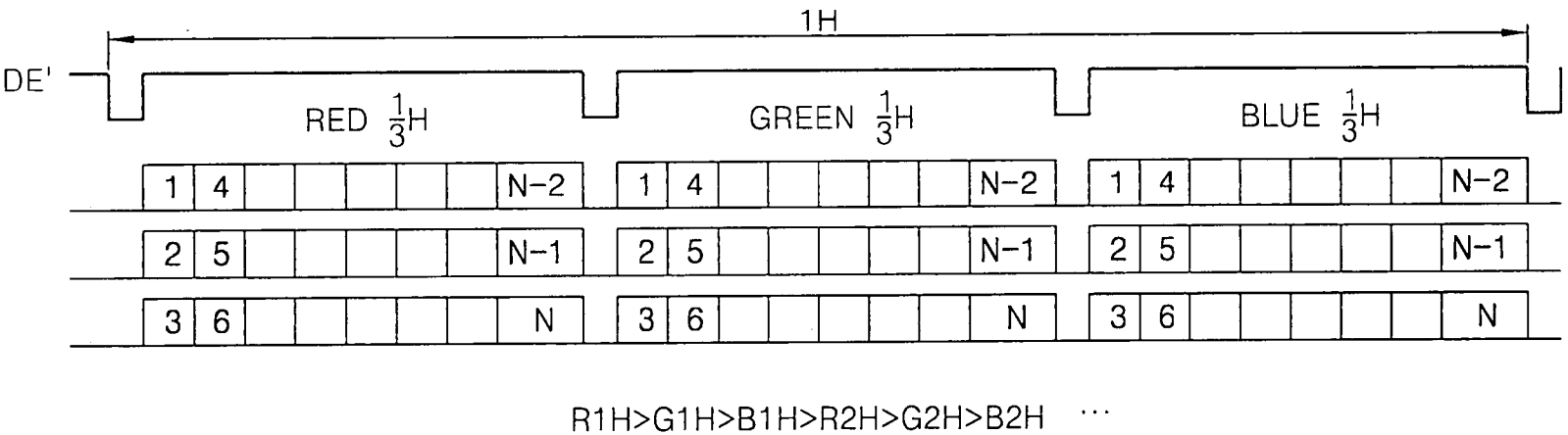
FIG. 14 is a configuration representing a data provided to a driver integrated circuit in accordance with a single port system.

Meanwhile, the timing controller 112 generates a modified data enable signal DE' having ⅓-horizontal period (⅓H) by using the data enable signal DE having one horizontal period 1H. If the timing controller 112 has one output port, the data stored in the first to the third line memories 170*a*, 170*b* and 170*c* are supplied to the data driver IC 150 via the output port during each of one period (i.e., ⅓ horizontal interval) of the modified data enable signal DE' as shown in FIG. 14. For instance, the red data is supplied to the data driver IC 150 during one period (⅓ horizontal interval) of a first modified data enable signal DE', the green data is supplied to the data driver IC 150 during one period (⅓-⅔ horizontal interval) of a second modified data enable signal DE', and the blue data is supplied to the data driver IC 150 during one period (⅔-⅓ horizontal interval) of a third modified data enable signal DE'. When the timing controller 112 has one output port, the red R, the green G and the blue B data are sequentially supplied to the data driver IC 150 during each period of the modified data enable signal DE' having ⅓ period.

Figure 15:
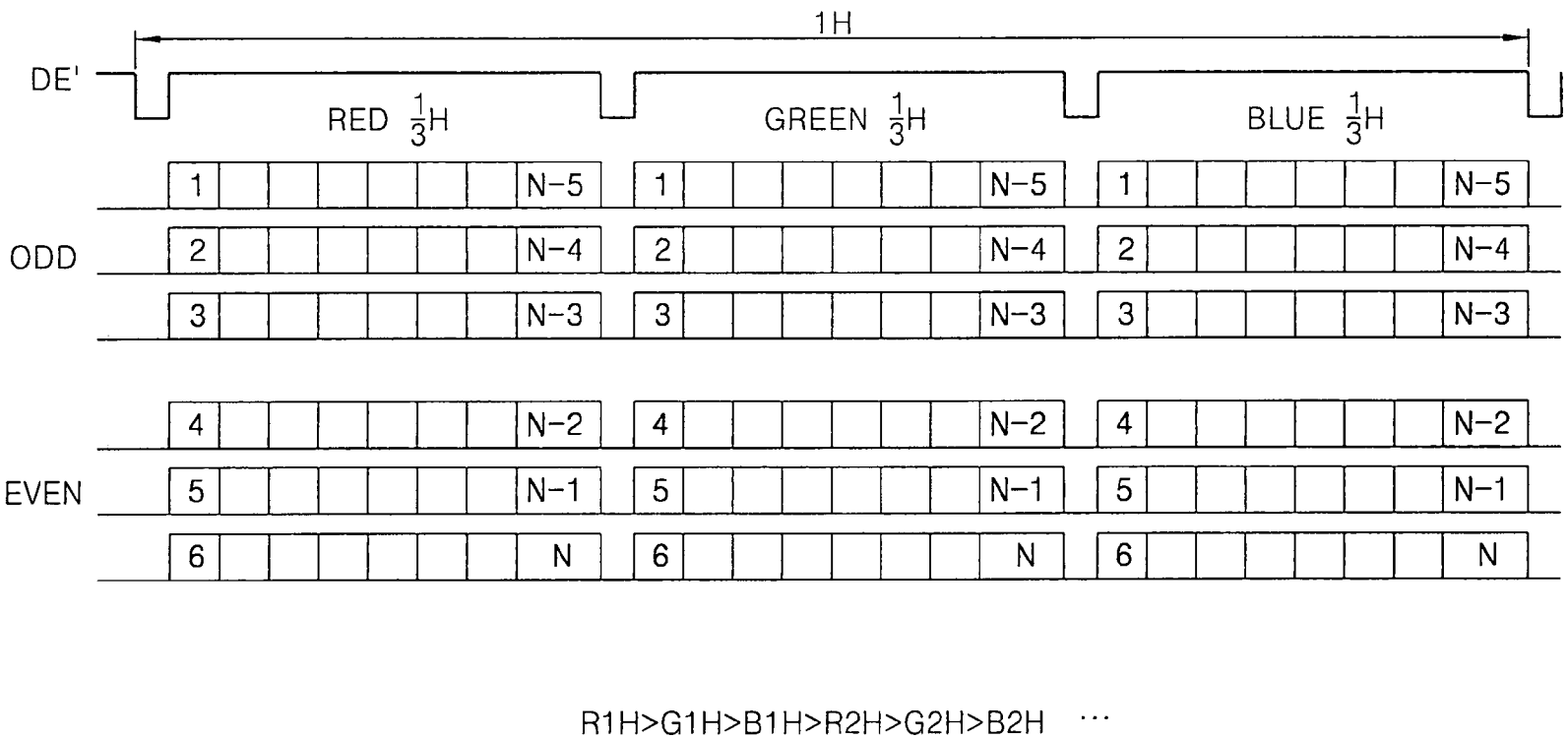
FIG. 15 is a configuration representing a data provided to a driver integrated circuit in accordance with a dual port system.

If the timing controller 112 has two output ports, the data stored in the first to the third line memories 170*a*, 170*b* and 170*c* is divided into odd data and even data and then is supplied to the data driver IC 150 during one period (⅓ horizontal interval) of the modified data enable signal DE' as shown in FIG. 15. For instance, the odd and even red R data are supplied to the data driver IC 150 during one period (⅓ horizontal interval) of the first modified data enable signal DE' and the odd and even green G data are supplied to the data driver IC 150 during one period (⅓-⅔ horizontal interval) of the second modified data enable signal DE'. Also, the odd and even blue B data are supplied to the data driver IC 150 during one period (⅔-⅓ horizontal interval) of the second modified data enable signal DE'. That is, when the timing controller 112 has two output ports, the red R, the green G and the blue B data are sequentially supplied to the data driver IC 150 during each period of the modified data enable signal DE' having ⅓ period.

Accordingly, the liquid crystal display apparatus according to the first embodiment of the present invention is capable of reducing the number of the data lines to a level by ⅔, to thereby reduce a power consumption and to reduce the number of the high cost data driver ICs.

Figure 16:
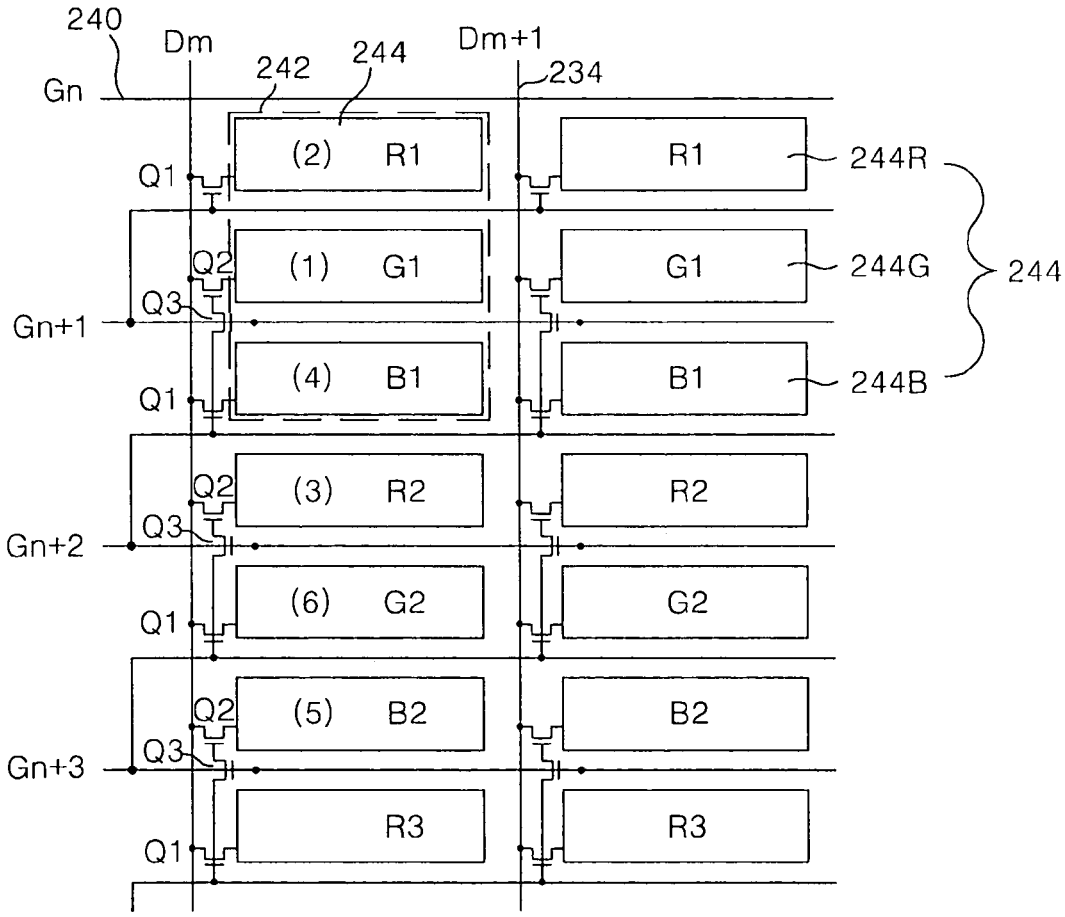
FIG. 16 is a plan view representing a structure of a pixel including color pixels of a liquid crystal display panel of a liquid crystal display apparatus according to a second embodiment of the present invention.
Figure 18:
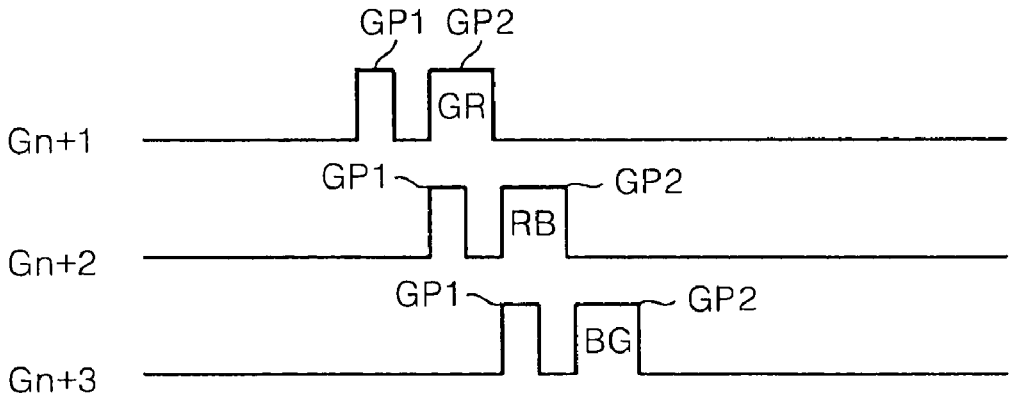
FIG. 18 is a waveform diagram representing a signal provided to the liquid crystal display panel shown in FIG. 16.

FIG. 16 is a plan view representing a structure of a color pixel of a liquid crystal display panel of a liquid crystal display apparatus according to a second embodiment of the present invention, and FIG. 18 is a waveform diagram representing signals provided to the liquid crystal display panel shown in FIG. 16.

The liquid crystal display apparatus according to the second embodiment of the present invention has identical elements and driving method as the liquid crystal display apparatus according to the first embodiment of the present invention except for the TFTs that drive color pixels 244 and the method of driving the TFTs. Therefore, a detailed explanation of identical elements to those of the liquid crystal display apparatus according to the first embodiment will be omitted.

Each of the TFTs to drive its corresponding color pixel 244 includes: a first TFT Q1, the first TFT Q1 being connected to a red pixel 244R and a data line 234 and receiving a gate pulse from a gate line Gn+1; a second TFT Q2, the second TFT Q2 being connected to green 244G and the data line 234 and receiving a gate pulse from a gate line Gn+2; and a third TFT Q3, the third TFT Q3 being connected to the gate line Gn+2 and the second TFT Q2 and providing a gate pulse supplied to the gate line Gn+2 to the second TFT Q2 in response to a gate pulse from the gate line Gn+1. At this time, a dummy gate line connected to the gate line Gn+2 is formed between the gate line Gn+1 and the gate line Gn+2. Each of the first, second, and third TFTs Q1, Q2 and Q3. drives a unit of two vertically adjacent pixels in response to the gate pulse from two gate lines Gn+1 and Gn+2.

Figure 17:
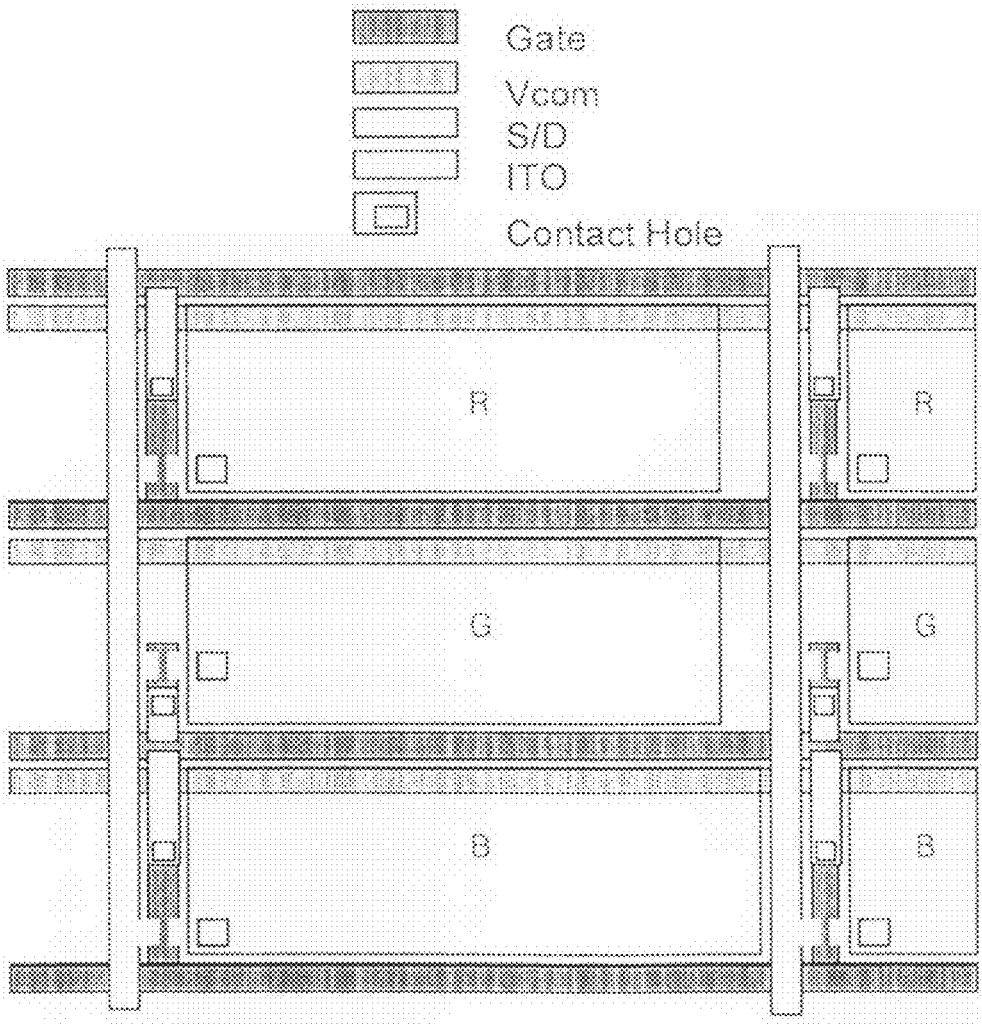
FIG. 17 is a plan view representing a layout of the liquid crystal display panel shown in FIG. 16.

A pixel 242, the color pixels 244 of the pixel 242, the TFTs Q1, Q2 and Q3 that drive the color pixels 244, a gate line 240 and a data line 234 of the liquid crystal display apparatus according to the second embodiment may be formed through a layout shown in FIG. 17.

The operation of the color pixels of the liquid crystal display panel will be described in detail in conjunction with FIGS. 16 and 18.

When a second gate pulse GP2 is supplied to the gate line Gn+1 when a first gate pulse GP1 is supplied to the gate line Gn+2, the first, second, and third TFTs Q1, Q2 and Q3 are turned-on. As the third TFT Q3 is turned-on by the second gate pulse GP2 supplied to the gate line Gn+1, the second TFT Q2 is turned-on by the first gate pulse GP1 supplied to the gate line Gn+2. As described above, if the second TFT Q2 is turned-on, the green G data supplied to a data line Dm is provided to a first green color pixel G1 via the second TFT Q2 and is simultaneously provided to a first red color pixel R1 via the first TFT Q1.

Then, in a period during which the first gate pulse GP1 supplied to the gate line Gn+2 is off and only the second gate pulse GP2 is supplied to the gate line Gn+1, the second TFT Q2 is turned-off by the first gate pulse GP1 and the first TFT Q1 maintains a turn-on state by the second gate pulse GP2. While the first TFT Q1 maintains a turn-on state, the red R data supplied to the data line Dm is provided to the first red color pixel R1 via the first TFT Q1. As a result, the green G data supplied to the first red color pixel R1 is changed to the red R data.

Thereafter, if the first and the second gate pulses GP1 and GP2 are supplied to a gate line Gn+3 and the gate line Gn+2, then, as described above, the red R data supplied to the data line Dm is provided to a second red color pixel R2 and a first blue color pixel B1 during the overlap of the first and the second gate pulses GP1 and GP2. Also, in a period during which the first gate pulse GP1 supplied to the gate line Gn+3 is off and only the second gate pulse GP2 is supplied to the gate line Gn+2, the blue B data supplied to the data line Dm is provided to the first blue color pixel B1 by the second gate pulse GP2 supplied to the gate line Gn+2. As a result, the red R data supplied to first blue color pixel B1 is changed to the blue B data.

Figure 19:
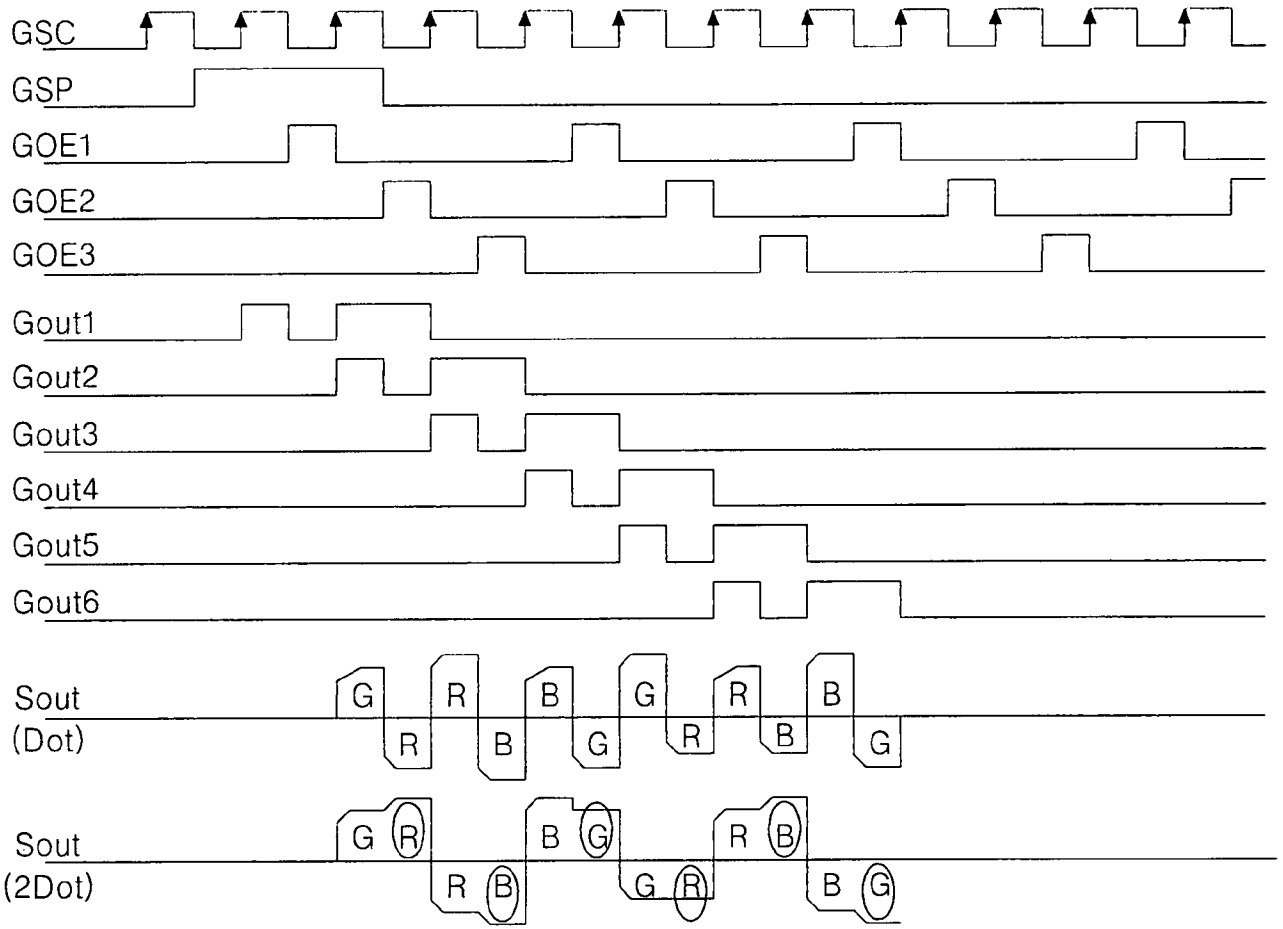
FIG. 19 is a waveform diagram representing a signal provided to the liquid crystal display apparatus and an output waveform according to the second embodiment of the present invention.

In the second embodiment of the present invention, the red R, the green G and the blue G data supplied to the data line Dm are provided to the color pixels 244 by repeating the process as described above. In the liquid crystal display apparatus according to the second embodiment of the present invention, the red R, the green G and the blue B supplied to the color pixels 244 are driven by using a one-dot inversion method or a two-dot inversion method as shown in FIG. 19.

Accordingly, the liquid crystal display apparatus according to the second embodiment of the present invention is capable of reducing the number of the data lines to a level by ⅔, to thereby reduce a power consumption and to reduce the number of the data driver Ics of a high cost to drive the data lines.

Figure 20:
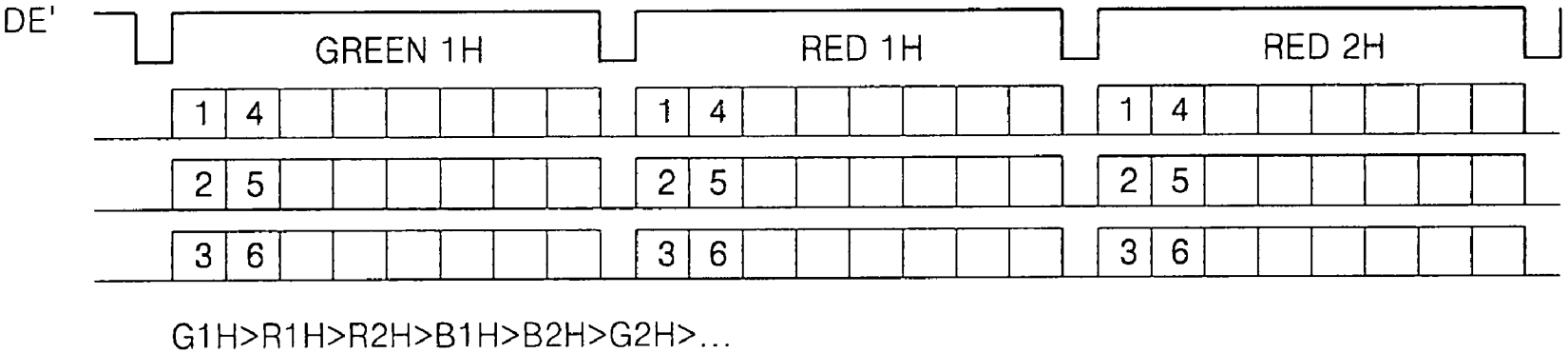
FIG. 20 is a configuration representing data input into a driver integrated circuit in accordance with a single port system applied to the second embodiment and a third embodiment of the present.

FIG. 20 is a configuration representing data provided to a driver IC by a single port system of the second embodiment and a third embodiment of the present invention.

The data signals provided to the driver IC by a single port system of the second and the third embodiments of the present invention in conjunction with FIGS. 16 and 20 is repeatedly inputted in order of G1(1)→ R1(2)→ R2(3)→ B1(4)→ B2(5)→ G2(6) as shown FIG. 20.

Figure 21:
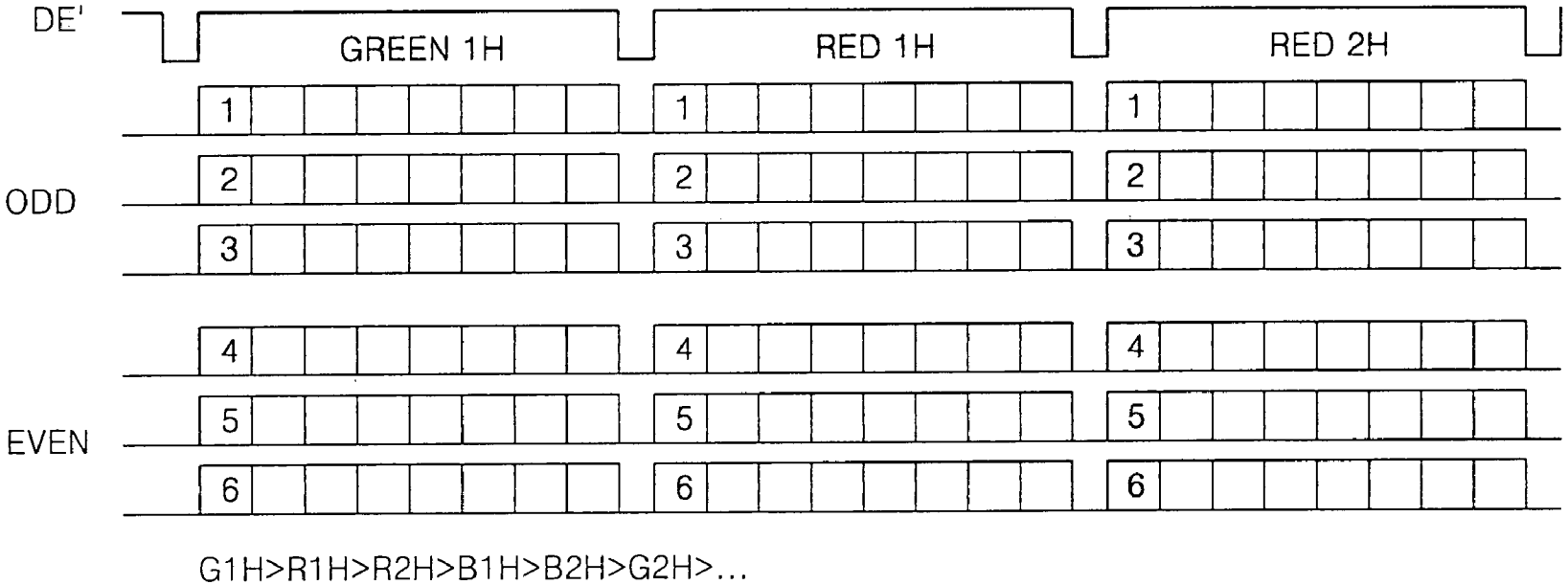
FIG. 21 is a configuration representing a data inputted to a driver integrated circuit in accordance with a dual port system according to the second and the third embodiments of the present invention.

FIG. 21 is a configuration representing data provided to a driver IC by a dual port system applied to the second and the third embodiments of the present invention.

The data signals provided to the driver IC by a single port system applied to the second and the third embodiments of the present invention in conjunction with FIGS. 16 and 21 is repeatedly inputted in order of G1(1)→ R1(2)→ R2(3)→ B1(4)→ B2(5)→ G2(6) as shown FIG. 21.

Figure 22:
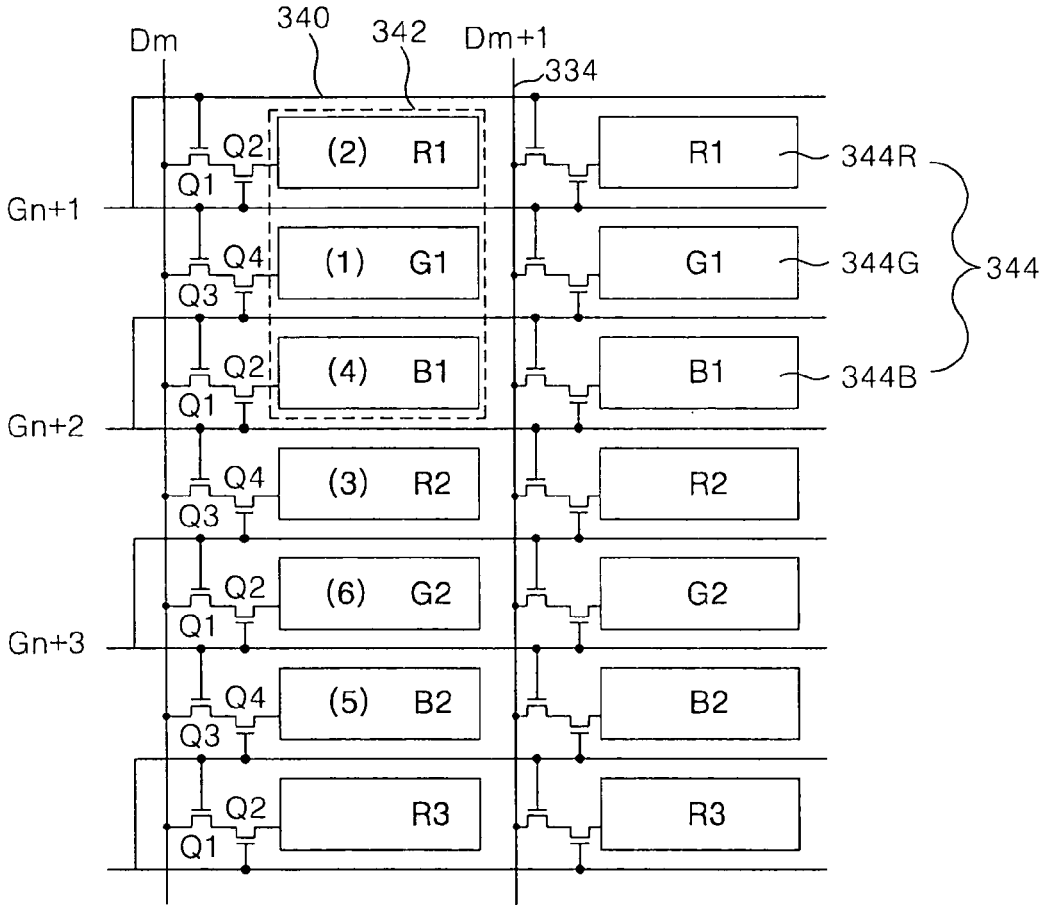
FIG. 22 is a plan view representing a structure of a color pixel constituting a pixel of a liquid crystal display panel of a liquid crystal display apparatus according to the second and the third embodiments of the present invention.
Figure 24:
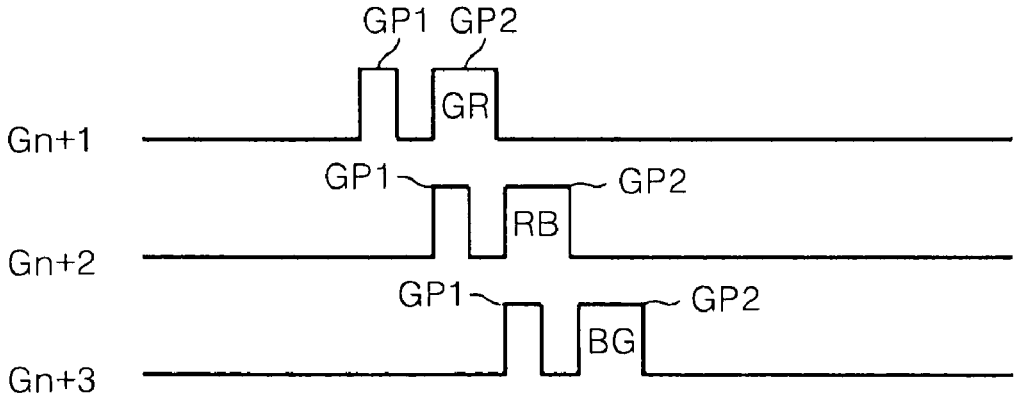
FIG. 24 is a waveform diagram representing a signal provided to the liquid crystal display panel shown in FIG. 22.

FIG. 22 is a plan view representing a structure of color pixels of a liquid crystal display panel of a liquid crystal display apparatus according to the third embodiment of the present invention, and FIG. 24 is a waveform diagram representing signals provided to the liquid crystal display panel shown in FIG. 22.

The liquid crystal display apparatus according to the third embodiment of the present invention has identical elements and driving method as the liquid crystal display apparatus according to the first embodiment of the present invention except for the TFTs Q1 and Q2 and the method of driving the TFTs to drive the color pixels. Therefore, a detailed explanation of identical elements to those of the liquid crystal display apparatus according to the first embodiment will be omitted.

The TFTs Q1 and Q2 to drive the color pixels 344 includes: a second TFT Q2, the second TFT Q2 being connected to odd-numbered color pixels 344 among color pixels 344 arranged in a vertical direction and a data line 334 and receiving a gate pulse from a gate line Gn+1; a first TFT Q1, the first TFT Q1 being connected to the second TFT Q2 and the data line 334 and receiving a gate pulse from a dummy line connected to the gate line Gn+1; a fourth TFT Q4, the fourth TFT Q4 being connected to even-numbered color pixels 344 and the data line 334 and receiving a gate pulse from a gate line Gn+2; and a third TFT Q3, the third TFT Q3 being connected to the fourth TFT Q4 and the data line 334 and receiving the gate pulse from the gate line Gn+1. A dummy gate line, which is connected to each of the gate lines Gn+1 and Gn+2, is formed between the color pixels 344. Each of the first to the fourth TFTs Q1, Q2, Q3 and Q4 drives a unit of two vertically adjacent pixels in response to the gate pulse from two gate lines Gn+1 and Gn+2.

Figure 23:
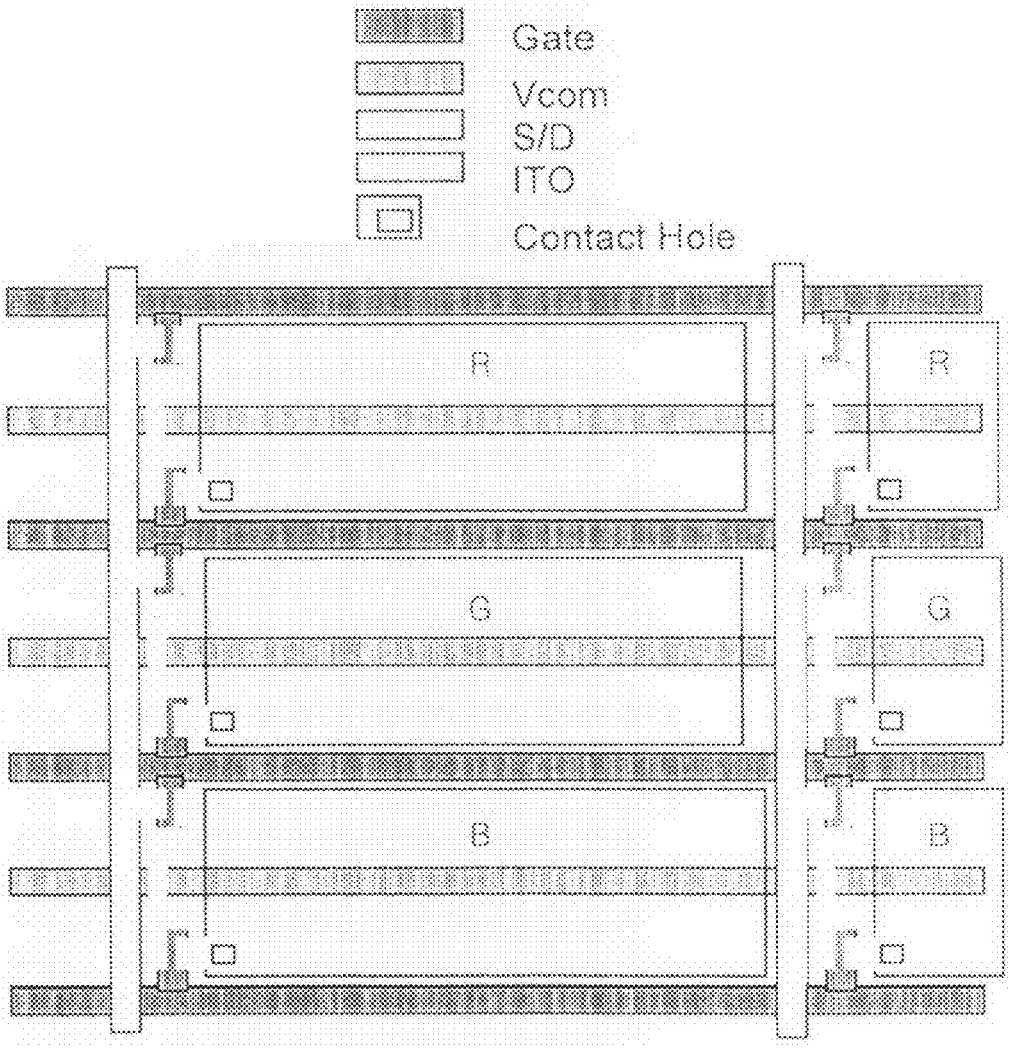
FIG. 23 is a plan view representing a layout of the liquid crystal display panel shown in FIG. 22.

A pixel 342, the color pixels 344 of the pixel 342, the TFTs Q1, Q2, Q3 and Q4 that drive the color pixels 344 a gate line 340 and a data line 334 of the liquid crystal display apparatus according to the second embodiment may be formed through a layout shown in FIG. 23.

The operation of the color pixels of the liquid crystal display panel will be described in detail in conjunction with FIGS. 22 and 24.

When a second gate pulse GP2 is supplied to the gate line Gn+1 when a first gate pulse GP1 is supplied to the gate line Gn+2, the first to the fourth TFTs Q1, Q2, Q3 and Q4 connected to the gate line Gn+1 and the gate line Gn+2 are turned-on. If the third and the fourth TFTs Q3 and Q4 are turned-on, the green G data supplied to the data line Dm is provided to a first green color pixel G1 connected to the fourth TFT Q4 via the turned-on third and fourth TFTs Q3 and Q4 . At the same time, the green G data is supplied to a first red color pixel R1 via the first and the second TFTs Q1 and Q2 connected to the gate line Gn+1, and supplied to a first blue color pixel B1 via the first and the second TFTs Q1 and Q2 connected to the gate line Gn+2.

Then, during a period in which the first gate pulse GP1 supplied to the gate line Gn+2 is off and only the second gate pulse GP2 is supplied to the gate line Gn+1, the fourth TFT Q4 is turned-off and the first to the third TFTs Q1, Q2 and Q3 maintain a turn-on state. As the first to the third TFTs Q1, Q2 and Q3 maintain the turn-on state, the red R data supplied to the data line Dm is provided to the first red color pixel R1 via the first and the second TFTs Q1 and Q2, while the fourth TFT Q4 connected to the first green color pixel G1 is turned-off. As a result, the red R data is not supplied to the first green color pixel G1.

Next, if the second gate pulse GP2 is supplied to the gate line Gn+2 when the first gate pulse GP1 is supplied to a gate line Gn+3 and, then the first to the fourth TFTs Q1 to Q4 connected to the gate line Gn+2 and the gate line Gn+3 are turned-on. If the third and the fourth TFTs Q3 and Q4 are turned-on, the red R data supplied to the data line Dm is provided to a second red color pixel R2 connected to the fourth TFT Q4 via the turned-on third TFT Q3. At the same time, the red G data is supplied to the first blue color pixel B1 via the first and the second TFTs Q1 and Q2 connected to the gate line Gn+2, and is supplied to the second green color pixel G2 via the first and the second TFTs Q1 and Q2 connected to the gate line Gn+3.

Next, in a period during which the first gate pulse GP1 supplied to the gate line Gn+3 is off and only the second gate pulse GP2 is supplied to the gate line Gn+2, the fourth TFT Q4 is turned-off and the first to the third TFTs Q1, Q2 and Q3 maintain a turn-on state. As the first to the third TFTs Q1, Q2 and Q3 maintain the turn-on state, the blue B data supplied to the data line Dm is provided to the first blue color pixel B1 via the first and the second TFTs Q1 and Q2, while the fourth TFT Q4 connected to the second red color pixel R2 is turned-off. As a result, the blue B data is not supplied to the second red color pixel R2.

In the third embodiment of the present invention, the red R, the green G and the blue G data supplied to the data line Dm are provided to the color pixels 444 by repeating the process as described above. In the liquid crystal display apparatus according to the third embodiment of the present invention, the red R, the green G and the blue B supplied to the color pixels 344 are driven by using a one-dot inversion method or a two-dot inversion method as shown in FIG. 19.

Accordingly, the liquid crystal display apparatus according to the third embodiment of the present invention is capable of reducing the number of the data lines by ⅔, to thereby reduce a power consumption and to reduce the number of the high cost data driver ICs to drive the data line.

As described above, the liquid crystal display apparatus according to embodiments of the present invention is capable of reducing the number of the data lines to supply data voltages to color pixels, in comparison with the related art. The increased gate lines accordingly are commonly tied by a set of two gate lines. As a result, the liquid crystal display apparatus is capable of reducing the number of the data lines by ⅔ and the number of the data driver ICs to drive the data lines, to thereby reducing the production cost of the liquid crystal display apparatus.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display apparatus comprising:

pixels including red, green and blue color pixels arranged in a direction along a data line;

gate line groups, each gate line group having a set of two gate lines electrically connected to each other, and each gate line crossing the data line;

a data driver that drives the data line, wherein the data driver supplies data to the data line;

a gate driver that drives the gate line groups; and a timing controller that controls the data driver and the gate driver, the timing controller having at least one line memory that temporarily stores data supplied to the data driver;

wherein the timing controller includes three line memories to store red data, green data and blue data supplied to the liquid crystal display;

wherein the timing controller modifies a data enable signal supplied to the timing controller to generate a modified data enable signal having period that is ⅓ of the horizontal period;

wherein the data stored in the line memory is supplied to the data driver every one period of the modified data enable signal;

wherein the gate driver sequentially supplies a first and a second gate pulse to each of the gate line groups;

wherein the first gate pulse supplied to an i+1th gate line group is overlapped with the second gate pulse supplied to an ith gate line group in a portion of the period;

wherein the first gate pulse has a pulse width that is narrower than the second gate pulse;

wherein, when the second gate pulse is supplied to the ith gate line group and the first gate pulse is supplied to the i+1th gate line group, a second thin film transistor (TFT) is turned-on by the second gate pulse supplied to the ith gate line group and a first TFT is turned-on by the first gate pulse being provided via the turned-on second TFT, to thereby supply designated data to a color pixel connected to the first TFT, and when the first gate pulse supplied to the i+1th gate line group is off and only the second gate pulse is supplied to the ith gate line group, a third TFT formed in the ith gate line group is turned-on, to thereby supply designated data to a color pixel connected to the turned-on third TFT.

2. The liquid crystal display apparatus of claim 1, wherein the data driver is synchronized with the modified data enable signal to supply any one of the red, the green and the blue data to the data line every ⅓ horizontal period.

3. The liquid crystal display apparatus of claim 2, wherein the data driver is synchronized with the modified data enable signal to invert polarities of the red, the green and the blue data sequentially supplied for every ⅓ horizontal period.

4. A liquid crystal display apparatus comprising:

pixels including red, green and blue color pixels arranged in a direction along a data line;

gate line groups, each gate line group having a set of two gate lines electrically connected to each other, and each gate line crossing the data line;

a data driver that drives the data line, wherein the data driver supplies data to the data line;

a gate driver that drives the gate line groups; and a timing controller that controls the data driver and the gate driver, the timing controller having at least one line memory that temporarily stores data supplied to the data driver;

wherein the timing controller includes three line memories to store red data, green data and blue data supplied to the liquid crystal display;

wherein the timing controller modifies a data enable signal supplied to the timing controller to generate a modified data enable signal having period that is ⅓ of the horizontal period;

wherein the data stored in the line memory is supplied to the data driver every one period of the modified data enable signal;

wherein the gate driver sequentially supplies a first and a second gate pulse to each of the gate line groups;

wherein the first gate pulse supplied to an i+1th gate line group is overlapped with the second gate pulse supplied to an ith gate line group in a portion of the period;

wherein the first gate pulse has a pulse width that is narrower than the second gate pulse;

wherein, when the second gate pulse is supplied to the ith gate line group and the first gate pulse is supplied to the i+1th gate line group, a third thin film transistor (TFT) is turned-on by the second gate pulse supplied to the ith gate line group and a second TFT is turned-on by the first gate pulse being provided via the turned-on third TFT, to thereby supply designated data to a color pixel connected to the second TFT, and when the first gate pulse supplied to the i+1th gate line group is off and only the second gate pulse is supplied to the ith gate line group, a first TFT is turned-on by the second pulse supplied to the ith gate line group, to thereby supply designated data to a color pixel connected to the turned-on first TFT.

5. The liquid crystal display apparatus of claim 4, wherein the data driver is synchronized with the modified data enable signal to supply the red, the green and the blue data to the data line for every ⅓ horizontal period in a vertical direction.

6. The liquid crystal display apparatus of claim 5, wherein the data driver is synchronized to the modified data enable signal to invert polarities of the red, the green and the blue data sequentially supplied for every ⅓ horizontal period.

7. A liquid crystal display apparatus comprising;

pixels including red, green and blue color pixels arranged in a direction along a data line;

gate line groups, each gate line group having a set of two gate lines electrically connected to each other, and each gate line crossing the data line;

a data driver that drives the data line, wherein the data driver supplies data to the data line;

a gate driver that drives the gate line groups; and a timing controller that controls the data driver and the gate driver, the timing controller having at least one line memory that temporarily stores data supplied to the data driver;

wherein the timing controller includes three line memories to store red data, green data and blue data supplied to the liquid crystal display;

wherein the timing controller modifies a data enable signal supplied to the timing controller to generate a modified data enable signal having period that is ⅓ of the horizontal period;

wherein the data stored in the line memory is supplied to the data driver every one period of the modified data enable signal;

wherein the gate driver sequentially supplies a first and a second gate pulse to each of the gate line groups;

wherein the first gate pulse supplied to an i+1th gate line group is overlapped with the second gate pulse supplied to an ith gate line group in a portion of the period;

wherein the first gate pulse has a pulse width that is narrower than the second gate pulse; wherein, when the second gate pulse is supplied to the ith gate line group and the first gate pulse is supplied to the i+1th gate line group, a third thin film transistor (TFT) and a fourth TFT are turned-on by the second gate pulse supplied to the ith gate line group, to thereby supply designated data to a color pixel connected to the fourth TFT, and when the first gate pulse supplied to the i+1th gate line group is off and only the second gate pulse is supplied to the ith gate line group, a first TFT and a second TFT which are formed in the ith gate line group are turned-on by the second pulse, to thereby supply designated data to a color pixel connected to the turned-on second TFT.

8. The liquid crystal display apparatus of claim 7, wherein the data driver is synchronized with the modified data enable signal to supply the red, the green and the blue to the data line for every ⅓ horizontal period in a vertical direction.

9. The liquid crystal display apparatus of claim 8, wherein the data driver is synchronized with the modified data enable signal to invert polarities of the red, the green and the blue data sequentially supplied for every ⅓ horizontal period.

10. A method of driving a liquid crystal display apparatus, the liquid crystal display apparatus including pixels with red, green and blue color pixels arranged in vertical along a data line; and gate line groups, each gate line group having a set of two gate lines electrically connected each other, each gate line crossing the data line, a data driver that drives the data line, wherein the data driver supplies data to the data line, the method comprising;

sequentially supplying a gate pulse having first and second gate pulses to the gate line group; and supplying designated data to each of the red, the green and the blue color pixels in accordance with the first and the second pulses sequentially supplied to the gate line group;

wherein the first gate pulse supplied to an i+1th gate line group is overlapped with the second gate pulse supplied to an ith gate line group in a portion of a period;

wherein the first gate pulse has a pulse width narrower than that of the second gate pulse;

wherein, in the step of supplying data, when the second gate pulse is supplied to the ith gate line group and the first gate pulse is supplied to the i+1th gate line group, a second thin film transistor (TFT) is turned-on by the second gate pulse supplied to the ith gate line group and a first TFT is turned-on by the first gate pulse being provided via the turned-on second TFT, to thereby supply designated data to a color pixel connected to the second TFT, and when the first gate pulse supplied to the i+1th gate line group is off and only the second gate pulse is supplied to the ith gate line group, a third TFT formed in the ith gate line group is turned-on, to thereby supply designated data to a color pixel connected to the turned-on third TFT.

11. The method of claim 10, wherein the step of supplying data includes supplying any one of the red, the green and the blue data to the data line for every ⅓ of a horizontal period.

12. The method of claim 11, wherein polarities of the data are inverted for every ⅓ horizontal period.

13. A method of driving a liquid crystal display apparatus, the liquid crystal display apparatus including pixels with red, green and blue color pixels arranged in vertical along a data line; and gate line groups, each gate line group having a set of two gate lines electrically connected each other, each gate line crossing the data line, a data driver that drives the data line, wherein the data driver supplies data to the data line, the method comprising: sequentially supplying a gate pulse having first and second gate pulses to the gate line group; and supplying designated data to each of the red, the green and the blue color pixels in accordance with the first and the second pulses sequentially supplied to the gate line group;

wherein, in the step of supplying the data, when the second gate pulse is supplied to the ith gate line group and the first gate pulse is supplied to the i+1th gate line group, a third thin film transistor (TFT) is turned-on by the second gate pulse supplied to the ith gate line group and then a second TFT is turned-on by the first gate pulse being provided via the turned-on third TFT, to thereby supply designated data to a color pixel connected to the second TFT, and when the first gate pulse supplied to the i+1th gate line group is off and only the second gate pulse is supplied to the ith gate line group, a first TFT is turned-on by the second gate pulse, to thereby supply designated data to a color pixel connected to the turned-on first TFT.

14. The method of claim 13, wherein the step of supplying data includes supplying the red, the green and the blue to the data line for every ⅓ horizontal period in a vertical direction.

15. The method of claim 14, wherein polarities of the data are inverted for every ⅓ horizontal period.

16. A method of driving a liquid crystal display apparatus, the liquid crystal display apparatus including pixels with red, green and blue color pixels arranged in vertical along a data line; and gate line groups, each gate line group having a set of two gate lines electrically connected each other, each gate line crossing the data line, a data driver that drives the data line, wherein the data driver supplies data to the data line, the method comprising: sequentially supplying a gate pulse having first and second gate pulses to the gate line group; and supplying designated data to each of the red, the green and the blue color pixels in accordance with the first and the second pulses sequentiallv supplied to the gate line group;

wherein, in the step of supplying the data, when the second gate pulse is supplied to the ith gate line group and the first gate pulse is supplied to the i+1th gate line group, a third TFT and a fourth TFT are turned-on by the second gate pulse supplied to the ith gate line group, to thereby supply designated data to a color pixel connected to the fourth TFT, and when the first gate pulse supplied to the i+1th gate line group is off and only the second gate pulse is supplied to the ith gate line group, a first TFT and a second TFT are turned-on, to thereby supply designated data to a color pixel connected to the turned-on second TFT.

17. The method of claim 16, wherein the step of supplying data includes supplying the red, the green and the blue data to the data line for every ⅓ horizontal period.

18. The method of claim 17, wherein polarities of the data are inverted for every ⅓ horizontal period.

* * * * *